US011769613B2

(12) United States Patent
Aoki et al.

(10) Patent No.: US 11,769,613 B2
(45) Date of Patent: Sep. 26, 2023

(54) THERMISTOR ELEMENT AND ELECTROMAGNETIC WAVE SENSOR

(71) Applicant: TDK CORPORATION, Tokyo (JP)

(72) Inventors: Susumu Aoki, Tokyo (JP); Shinji Hara, Tokyo (JP); Naoki Ohta, Tokyo (JP); Maiko Shirokawa, Tokyo (JP); Eiji Komura, Tokyo (JP)

(73) Assignee: TDK CORPORATION, Tokyo (JP)

( * ) Notice: Subject to any disclaimer, the term of this patent is extended or adjusted under 35 U.S.C. 154(b) by 0 days.

(21) Appl. No.: 17/539,480

(22) Filed: Dec. 1, 2021

(65) Prior Publication Data

US 2022/0181050 A1 Jun. 9, 2022

(30) Foreign Application Priority Data

Dec. 4, 2020 (JP) ..... 2020-201816

(51) Int. Cl.
*H01C 7/00* (2006.01)
*H01C 1/14* (2006.01)
*H01C 7/04* (2006.01)

(52) U.S. Cl.
CPC ..... *H01C 7/008* (2013.01); *H01C 1/1413* (2013.01); *H01C 7/041* (2013.01); *H01C 7/043* (2013.01)

(58) Field of Classification Search
CPC ..... H01C 1/1413; H01C 1/14; H01C 17/28; H01C 7/008; H01C 7/041; H01C 7/043; H01C 7/00; G01J 1/44
USPC ..... 338/22 R
See application file for complete search history.

(56) References Cited

U.S. PATENT DOCUMENTS

2017/0162303 A1* 6/2017 Strallhofer ..... H01C 7/008
2019/0320515 A1* 10/2019 Sadwick ..... H05B 45/00
2020/0408604 A1 12/2020 Ohta et al.

FOREIGN PATENT DOCUMENTS

JP 2016-191705 A 11/2016
WO 2019/171488 A1 9/2019

* cited by examiner

*Primary Examiner* — Edwin A. Leon
*Assistant Examiner* — Iman Malakooti
(74) *Attorney, Agent, or Firm* — Oliff PLC

(57) ABSTRACT

A thermistor element includes: a thermistor film; a first electrode provided in contact with one surface of the thermistor film; and a pair of second electrodes provided in contact with an other surface of the thermistor film, wherein the thermistor film is provided to cover a periphery of the first electrode.

8 Claims, 18 Drawing Sheets

THERMISTOR ELEMENT AND ELECTROMAGNETIC WAVE SENSOR

BACKGROUND

The present disclosure relates to a thermistor element and an electromagnetic wave sensor.

Priority is claimed on Japanese Patent Application No. 2020-201816, filed on Dec. 4, 2020 the content of which are incorporated herein by reference.

For example, there is a temperature sensor using a thermistor element (see, for example, Patent Document 1 below). Also, there is an electromagnetic wave sensor using a thermistor element (see, for example, Patent Document 2 below).

The electrical resistance of a thermistor film included in a thermistor element changes according to change in temperature of the thermistor film. In an electromagnetic wave sensor, infrared rays (electromagnetic waves) incident on a thermistor film are absorbed by the thermistor film or materials around the thermistor film, and thereby a temperature of the thermistor film changes. Thereby, the thermistor element detects the infrared rays (electromagnetic waves).

Here, according to the Stefan-Boltzmann law, there is a correlation between a temperature of a measurement target and infrared rays (radiant heat) emitted from the measurement target by thermal radiation. Therefore, when infrared rays emitted from a measurement target are detected using a thermistor element, a temperature of the measurement target can be measured in a non-contact manner.

Also, such a thermistor element is applied to an electromagnetic wave sensor such as an infrared imaging element (infrared image sensor) that detects (images) a temperature distribution of a measurement target two-dimensionally by disposing a plurality of thermistor elements in an array.

PATENT DOCUMENTS

[Patent Document 1] Japanese Unexamined Patent Application, First Publication No. 2016-191705

[Patent Document 2] PCT International Publication No. WO 2019/171488

SUMMARY

Incidentally, as a structure of an element of the above-described thermistor element, there are the CIP (Current-In-Plane) structure in which a current is caused to flow in an in-plane direction of a thermistor film and the CPP (Current-Perpendicular-to-Plane) structure in which a current flows in a direction perpendicular to a plane of the thermistor film.

In the CIP structure, the resistance of the thermistor film increases. On the other hand, in the CPP structure, the resistance of the thermistor film can be lowered as compared with the CIP structure.

However, when a CPP structure is adopted for the thermistor element, the lower electrode in contact with the lower surface of the thermistor film; and the pair of the upper electrodes in contact with the upper surface of the thermistor film, are in a state of being close to each other in a direction perpendicular to a plane of the thermistor film with the edge of the thermistor film in between.

Therefore, if a short circuit (short path) occurs between the lower and upper electrodes across the edge of the thermistor film, the current cannot flow properly in a direction perpendicular to a plane of the thermistor film. Therefore, the electromagnetic wave sensor equipped with such a thermistor element will not be able to obtain the desired characteristics, which may lead to a decrease in reliability.

It is desirable to provide a thermistor element capable of appropriately passing a current in a direction perpendicular to a plane of the thermistor film, and an electromagnetic wave sensor that is equipped with such a thermistor element, thereby making it possible to improve reliability.

Following means are provided.

A thermistor element including a thermistor film; a first electrode provided in contact with one surface of the thermistor film; and a pair of second electrodes provided in contact with an other surface of the thermistor film, wherein the thermistor film is provided to cover a periphery of the first electrode.

An electromagnetic wave sensor including the thermistor element.

According to the present disclosure, it is possible to provide a thermistor element capable of appropriately passing a current in a direction perpendicular to a plane of the thermistor film, and an electromagnetic wave sensor that is equipped with such a thermistor element, thereby making it possible to improve reliability.

DETAILED DESCRIPTION

Figure 1:
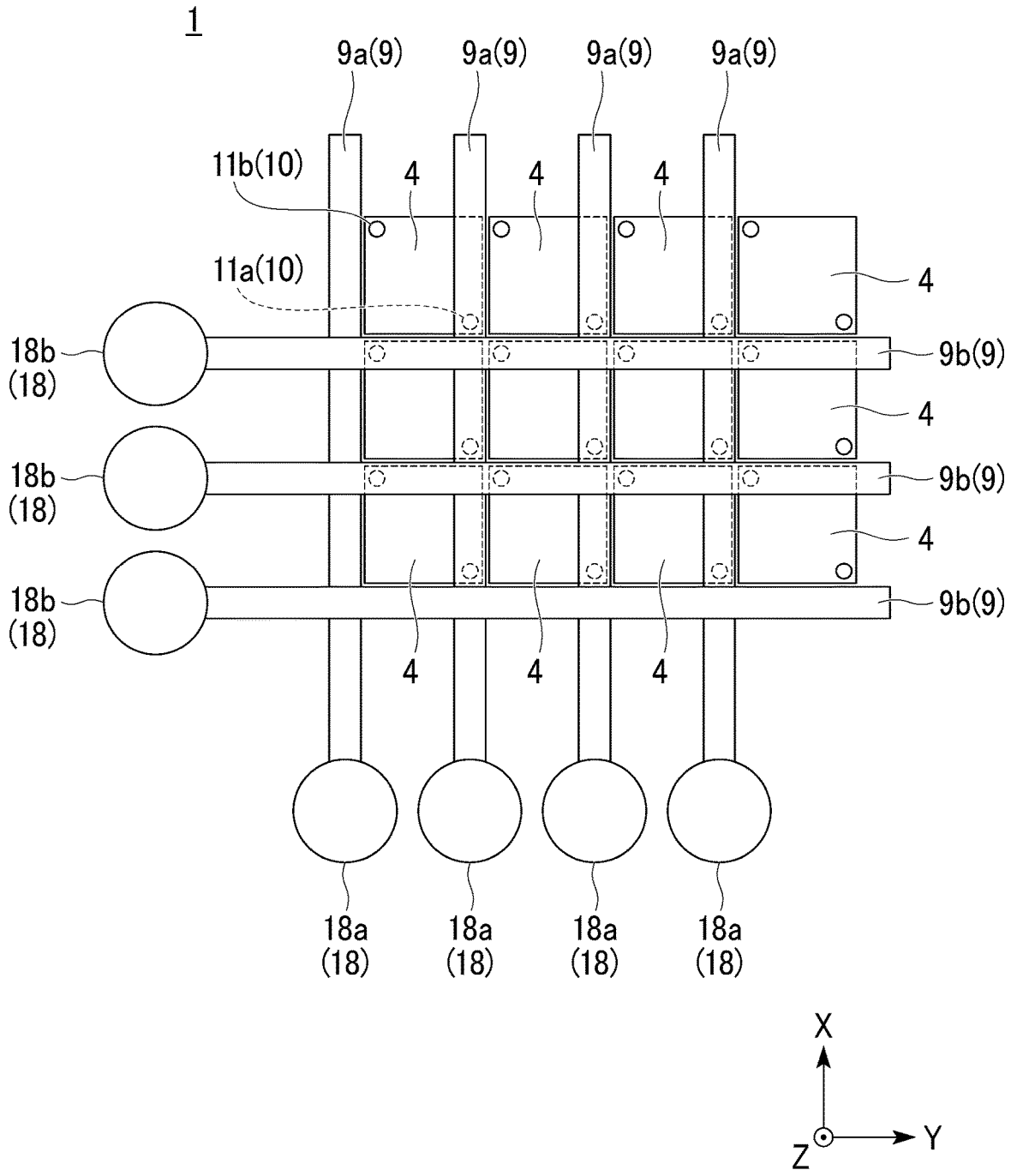
FIG. 1 is a plan view showing a configuration of an electromagnetic wave sensor according to an embodiment of the present disclosure.

Hereinafter, an embodiment of the present disclosure will be described in detail with reference to the drawings.

In the drawings used in the following description, in order to make the respective constituent elements easier to see, scales of dimensions may be different depending on the constituent elements, and dimensional proportions and the like between respective constituent elements may not be the same as the actual ones. Also, materials and the like illustrated in the following description are merely examples, and the present disclosure is not necessarily limited thereto and can be implemented with appropriate modifications within a range not changing the gist thereof.

Also, in the drawings illustrated below, an XYZ orthogonal coordinate system is set, in which an X-axis direction is set as a first direction X in a specific plane of the electromagnetic wave sensor, a Y-axis direction is set as a second direction Y perpendicular to the first direction X in the specific plane of the electromagnetic wave sensor, and a Z-axis direction is set as a third direction Z perpendicular to the specific plane of the electromagnetic wave sensor.

Electromagnetic Wave Sensor

First, as an embodiment of the present disclosure, the electromagnetic wave sensor 1 shown in FIGS. 1 to 3, for example, will be described.

FIG. 1 is a plan view of the electromagnetic wave sensor 1.

Figure 2:
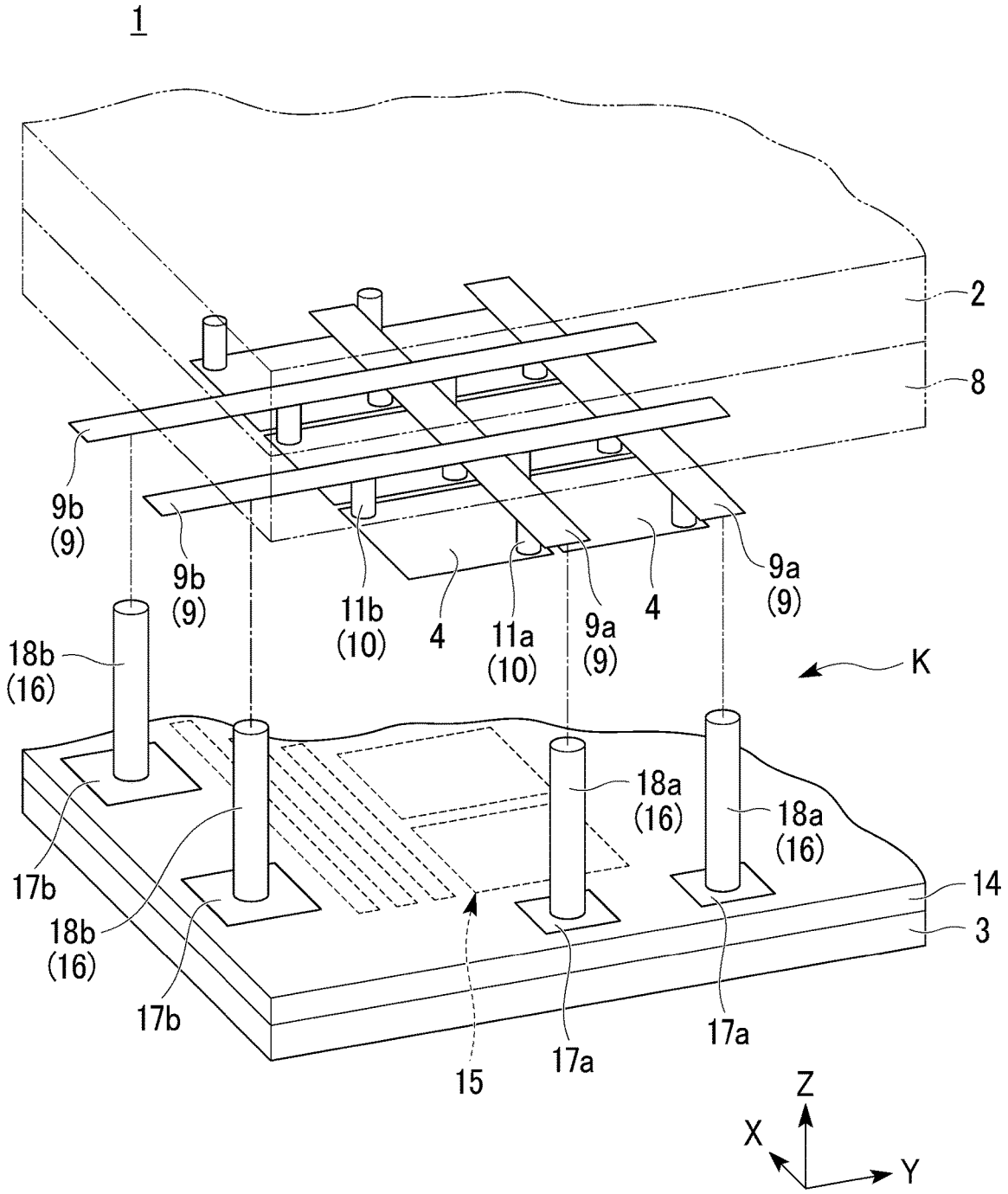
FIG. 2 is a disassembled perspective view showing the configuration of the electromagnetic wave sensor shown in FIG. 1.

FIG. 2 is an exploded view of the electromagnetic wave sensor 1.

Figure 3:
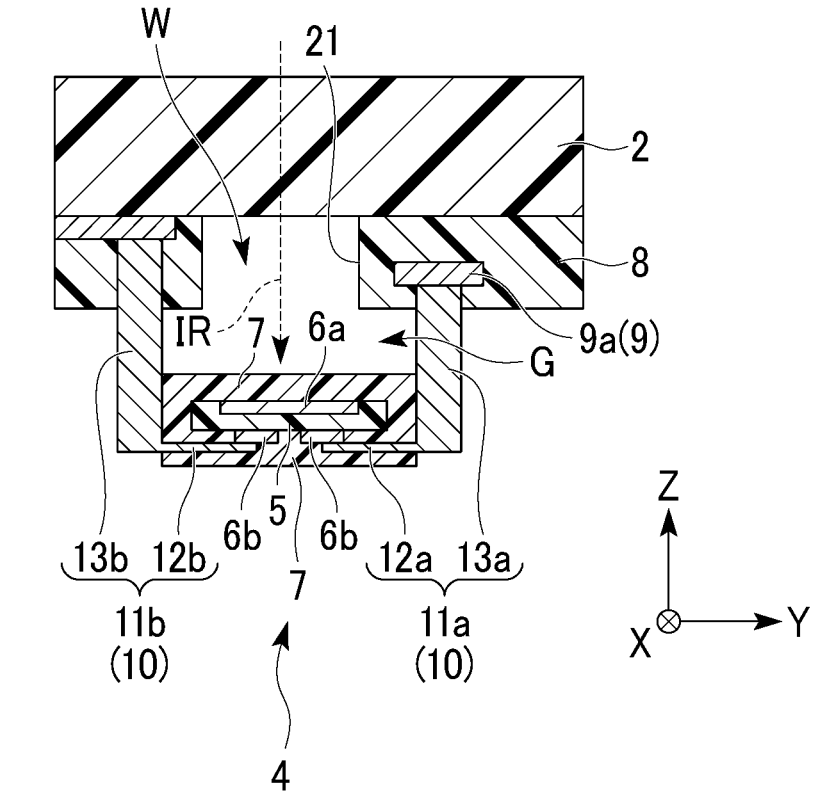
FIG. 3 is a cross-sectional view showing the configuration of the electromagnetic wave sensor shown in FIG. 1.

FIG. 3 is a cross-sectional view of the electromagnetic wave sensor 1.

The electromagnetic wave sensor 1 of the present embodiment is an application of the present disclosure to an infrared imaging element (infrared image sensor) that detects (images) a temperature distribution of a measurement target two-dimensionally by detecting infrared rays (electromagnetic waves) emitted from the measurement target.

Infrared rays are electromagnetic waves having a wavelength of 0.75 μm or more and 1000 μm or less. An infrared image sensor is used as an infrared camera for indoor or outdoor night vision and is used as a non-contact temperature sensor for measuring a temperature of people or objects.

Specifically, as illustrated in FIGS. 1 to 3, the electromagnetic wave sensor 1 includes a first substrate 2 and a second substrate 3 disposed to face each other, and a plurality of thermistor elements 4 disposed between the first substrate 2 and the second substrate 3.

The first substrate 2 and the second substrate 3 are formed of a silicon substrate having transmittance with respect to electromagnetic waves IR having a specific wavelength (long-wavelength infrared rays having a wavelength of 8 to 14 μm in the present embodiment) (hereinafter referred to as "infrared rays"). Also, as the substrate having transmittance with respect to the infrared rays IR, a germanium substrate or the like can be used.

The first substrate 2 and the second substrate 3 form an internal space K therebetween by circumferences of surfaces facing each other being sealed with a sealing material (not illustrated). Also, the pressure of the internal space K is reduced to a high vacuum. Thereby, in the electromagnetic wave sensor 1, an influence of heat due to convection in the internal space K is suppressed, and an influence of heat other than the infrared rays IR emitted from the measurement target on the thermistor elements 4 is suppressed.

Further, the electromagnetic wave sensor 1 of the present embodiment is not necessarily limited to a configuration in which the pressure of the above-described sealed internal space K is reduced and may have a configuration in which the internal space K is sealed or open at atmospheric pressure.

The thermistor elements 4 each include the thermistor film 5 that detects infrared rays IR, the first electrode **6*a* provided in contact with one surface of the thermistor film 5, the pair of second electrodes 6*b* provided in contact with the other surface of the thermistor film 5, and a dielectric film 7 that covers the thermistor film 5, and have a current-perpendicular-to-plane (CPP) structure in which a current flows in a direction perpendicular to a plane of the thermistor film 5**.

In other words, in the thermistor element 4, it is possible to flow current in a direction perpendicular to a plane of the thermistor film 5 from one second electrode 6*b* to the first electrode 6*a*, and at the same time, to flow current in a direction perpendicular to a plane of the thermistor film 5 from the first electrode 6*a* to the other second electrode 6*b*.

For example, vanadium oxide, amorphous silicon, polycrystalline silicon, spinel-type crystalline structure oxide containing manganese, titanium oxide, or yttrium-barium-copper oxide may be used as the thermistor film 5.

For example, a conductive film such as platinum (Pt), gold (Au), palladium (Pd), ruthenium (Ru), silver (Ag), rhodium (Rh), iridium (Ir), or osmium (Os) may be used as the first electrode 6*a* and the second electrode 6*b*.

For the dielectric film 7, for example, aluminum nitride, silicon nitride, aluminum oxide, silicon oxide, magnesium oxide, tantalum oxide, niobium oxide, hafnium oxide, zirconium oxide, germanium oxide, yttrium oxide, tungsten oxide, bismuth oxide, calcium oxide, aluminum oxynitride, silicon oxynitride, aluminum magnesium oxide, silicon boride, boron nitride, sialon (oxynitride of silicon and aluminum), or the like can be used.

The dielectric film 7 may be configured to cover at least a part of at least the thermistor film 5. In the present embodiment, the dielectric film 7 is provided to cover both surfaces of the thermistor film 5.

The plurality of thermistor elements 4 have the same size as each other and are each formed in a rectangular shape (square shape in the present embodiment) in a plan view. Also, the plurality of thermistor elements 4 are arranged in an array in a plane parallel to the first substrate 2 and the second substrate 3 (hereinafter, referred to as "in a specific plane"). That is, the plurality of thermistor elements 4 are disposed to be aligned in a matrix in the first direction X and the second direction Y that intersect each other (orthogonally in the present embodiment) in a specific plane.

Also, when the first direction X is referred to as a row direction and the second direction Y is referred to as a column direction, the thermistor elements 4 are disposed to be aligned at regular intervals in the first direction X and disposed to be aligned at regular intervals in the second direction Y.

Further, examples of a size of matrix of the above-described thermistor elements 4 include 640 rows×480 columns and 1024 rows×768 columns, but the size of the matrix is not necessarily limited thereto and can be changed as appropriate.

On the first substrate 2 side, a first insulator layer 8, a wiring part 9 electrically connected to a circuit unit 15 to be described later, and a first connecting part 10 for electrically connecting between each thermistor element 4 and the wiring part 9 are provided.

The first insulator layer 8 is formed of an insulating film laminated on one surface (a surface facing the second substrate 3) side of the first substrate 2. For the insulating film, for example, aluminum nitride, silicon nitride, aluminum oxide, silicon oxide, magnesium oxide, tantalum oxide, niobium oxide, hafnium oxide, zirconium oxide, germanium oxide, yttrium oxide, tungsten oxide, bismuth oxide, calcium oxide, aluminum oxynitride, silicon oxynitride, aluminum magnesium oxide, silicon boride, boron nitride, sialon (oxynitride of silicon and aluminum), or the like can be used.

The wiring part 9 includes a plurality of first lead wirings 9*a* and a plurality of second lead wirings 9*b*. The first lead wirings 9*a* and the second lead wirings 9*b* are formed of a conductive film such as, for example, copper or gold.

The plurality of first lead wirings 9*a* and the plurality of second lead wirings 9*b* are positioned in different layers in the third direction Z of the first insulator layer 8 and are disposed to intersect three-dimensionally. Of these, the plurality of first lead wirings 9*a* extend in the first direction X and are provided to be aligned in the second direction Y at regular intervals. On the other hand, the plurality of second lead wirings 9*b* extend in the second direction Y and are provided to be aligned in the first direction X at regular intervals.

The thermistor elements 4 are each provided for each region defined by the plurality of first lead wirings 9*a* and the plurality of second lead wirings 9*b* in a plan view. In a region facing each thermistor film 5 in a thickness direction of the first substrate 2 (a region overlapping in a plan view), there is a window portion W that allows infrared rays IR to be transmitted between the first substrate 2 and the thermistor film 5.

The first connecting part 10 includes a pair of first connecting members 11*a* and 11*b* provided corresponding to each of the plurality of thermistor elements 4. Also, the pair of first connecting members 11*a* and 11*b* have a pair of arm parts 12*a* and 12*b* and a pair of leg parts 13*a* and 13*b*.

The arm parts 12*a* and 12*b* are each formed of a bent line-shaped conductor pattern formed along a circumference of the thermistor element 4 using a thin film of such as, for example, titanium or titanium nitride. The leg parts 13*a* and 13*b* are each formed of a conductor pillar having a circular cross section formed to extend in the third direction Z using plating of such as, for example, copper, gold, FeCoNi alloy, or NiFe alloy (permalloy).

One first connecting member 11*a* includes one arm part 12*a* electrically connected to one second electrode 6*b* and one leg part 13*a* for electrically connecting between one arm part 12*a* and the first lead wiring 9*a* to electrically connect between one second electrode 6*b* and the first lead wiring 9*a*.

The other first connecting member 11*b* includes the other arm part 12*b* electrically connected to the other second electrode 6*b* and the other leg part 13*b* for electrically connecting between the other arm part 12*b* and the second lead wiring 9*b* to electrically connect between the other second electrode 6*b* and the second lead wiring 9*b*.

Thereby, the thermistor element 4 is supported in a state of being suspended in the third direction Z by the pair of first connecting members 11*a* and 11*b* positioned in a diagonal direction in the plane thereof. Also, a space G is provided between the thermistor element 4 and the first insulator layer 8.

Although illustration is omitted, a plurality of selection transistors (not illustrated) for selecting one thermistor element 4 from the plurality of thermistor elements 4 are provided on one surface (a surface facing the second substrate 3) side of the first substrate 2. The plurality of selection transistors are provided at positions on the first substrate 2 respectively corresponding to the plurality of thermistor elements 4. Also, the selection transistors are each provided at a position other than the above-described window portion W to prevent diffuse reflection of the infrared rays 1R and deterioration in efficiency of incidence.

On the second substrate 3 side, a second insulator layer 14, the circuit unit 15 that detects a change in voltage output from the thermistor element 4 to convert it into a brightness temperature, and a second connecting part 16 for electrically connecting between each thermistor element 4 and the circuit unit 15 are provided.

The second insulator layer 14 is formed of an insulating film laminated on one surface (a surface facing the first substrate 2) side of the second substrate 3. As the insulating film, the same insulating film as that exemplified in the first insulator layer 8 described above can be used.

The circuit unit 15 includes a read out integrated circuit (ROTC), a regulator, an analog-to-digital converter (A/D converter), a multiplexer, and the like and is provided in the second insulator layer 14.

Also, a plurality of connecting terminals 17*a* and 17*b* respectively corresponding to the plurality of first lead wirings 9*a* and the plurality of second lead wirings 9*b* are provided on a surface of the second insulator layer 14. The connecting terminals 17*a* and 17*b* are formed of a conductive film such as, for example, copper or gold.

The connecting terminals 17*a* on one side are positioned in a region surrounding a circumference of the circuit unit 15 on one side in the first direction X and are provided to be aligned at regular intervals in the second direction Y. The connecting terminals 17*b* on the other side are positioned in a region surrounding the circumference of the circuit unit 15 on one side in the second direction Y and are provided to be aligned at regular intervals in the first direction X.

The second connecting parts 16 include a plurality of second connecting members 18*a* and 18*b* provided corresponding to the plurality of first lead wirings 9*a* and the plurality of second lead wirings 9*b*. The plurality of second connecting members 18*a* and 18*b* are formed of conductor pillars having a circular cross section formed to extend in the third direction Z using plating of such as, for example, copper or gold.

The second connecting members 18*a* on one side electrically connect one end sides of the first lead wirings 9*a* and the connecting terminals 17*a* on one side. The second connecting members 18*b* on the other side electrically connect one end sides of the second lead wirings 9*b* and the connecting terminals 17*b* on the other side. Thereby, the plurality of first lead wirings 9*a* and the circuit unit 15 are electrically connected via the second connecting members 18*a* on one side and the connecting terminals 17*a* on one side. Also, the plurality of second lead wirings 9*b* and the circuit unit 15 are electrically connected via the second connecting members 18*b* on the other side and the connecting terminals 17*b* on the other side.

In the electromagnetic wave sensor 1 of the present embodiment having the above configuration, the infrared rays IR emitted from the measurement target are incident on the thermistor element 4 from the first substrate 2 side through the window portion W.

In the thermistor element 4, the infrared rays IR incident on the dielectric film 7 formed in the vicinity of the thermistor film 5 are absorbed by the dielectric film 7, the infrared rays IR incident on the thermistor film 5 are absorbed by the thermistor film 5, and thereby a temperature of the thermistor film 5 changes. Also, in the thermistor element 4, an electrical resistance of the thermistor film 5 changes in response to temperature change of the thermistor film 5, and thereby an output voltage between the pair of second electrodes 6 changes. In the electromagnetic wave sensor 1 of the present embodiment, the thermistor element 4 functions as a bolometer element.

In the electromagnetic wave sensor 1 of the present embodiment, the infrared rays IR emitted from the measurement target are detected in a planar manner by the plurality of thermistor elements 4, then an electrical signal (voltage signal) output from each of the thermistor elements 4 is converted into a brightness temperature, and thereby a temperature distribution (temperature image) of the measurement target can be detected (imaged) two-dimensionally.

Further, when a constant voltage is applied to the thermistor film 5, it is also possible for the thermistor element 4 to detect a change in current flowing through the thermistor film 5 in response to a temperature change of the thermistor film 5 and convert it into a brightness temperature.

[Thermistor Element]

First Embodiment

As the first embodiment of the present disclosure, the thermistor element 4, which are shown in FIGS. 4 to 7 are described, for example.

Figure 4:
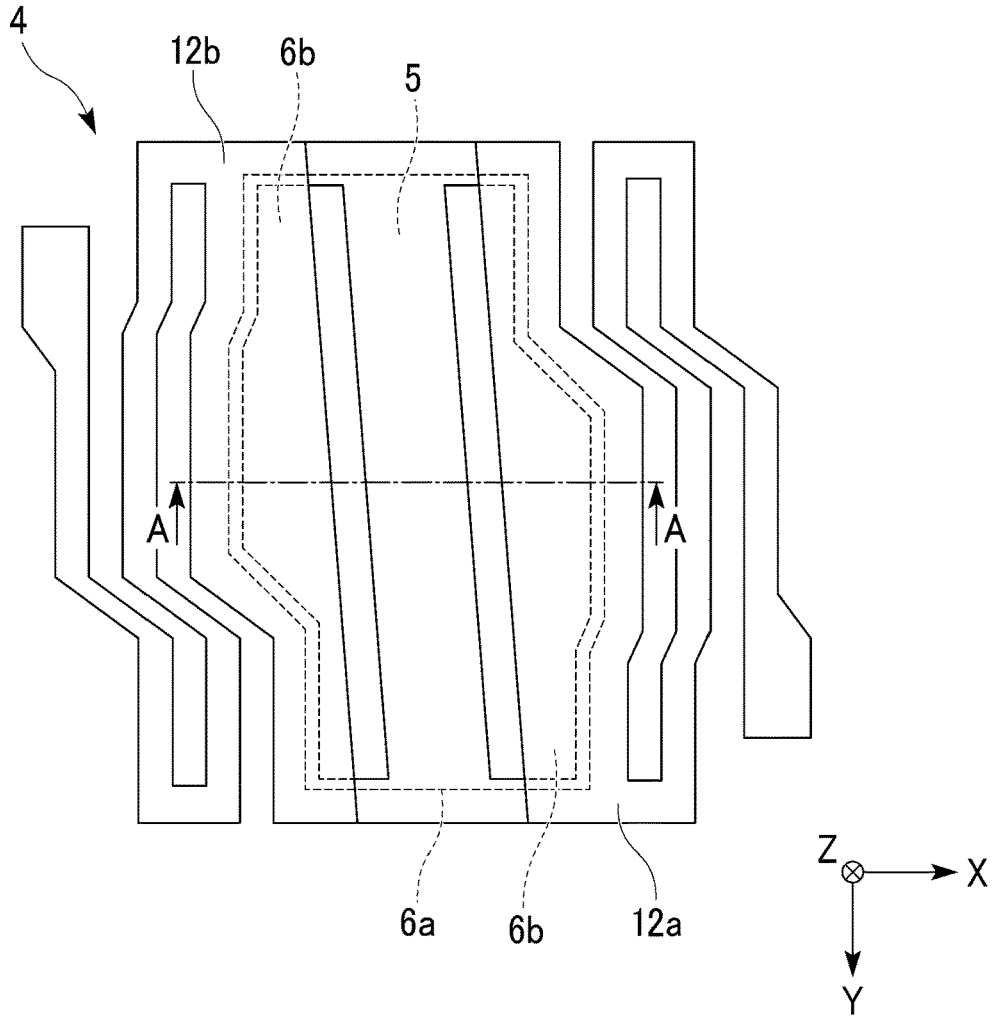
FIG. 4 is a plan view showing a configuration of a thermistor element according to a first embodiment of the present disclosure.
Figure 5:
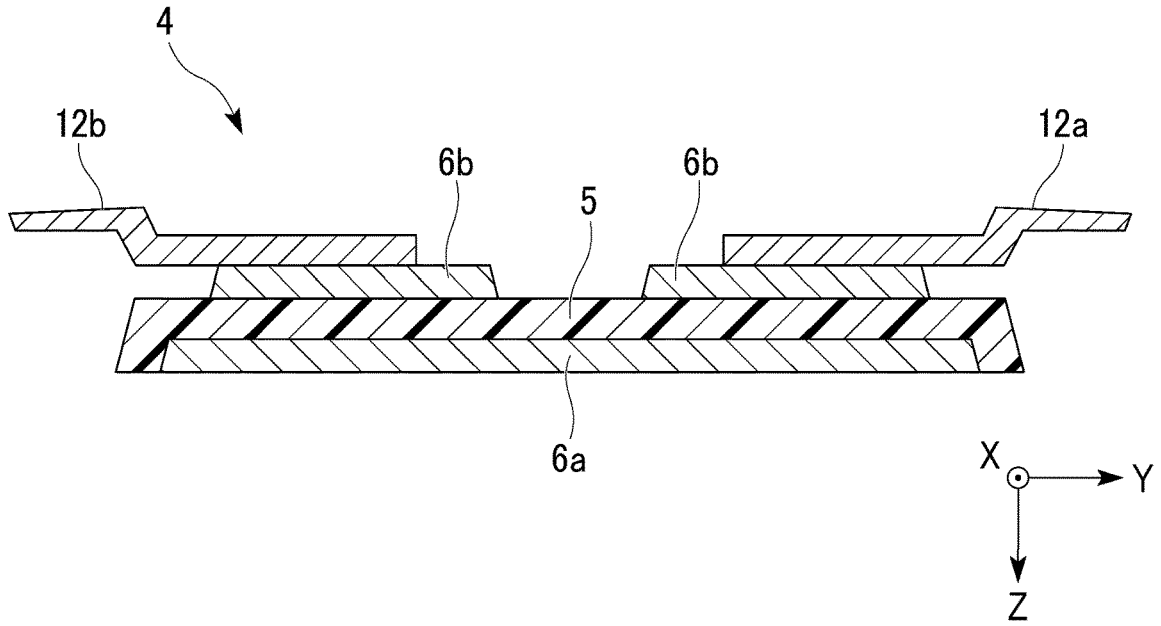
FIG. 5 is a cross-sectional view of the thermistor element with line segments AA shown in FIG. 4.
Figure 6:
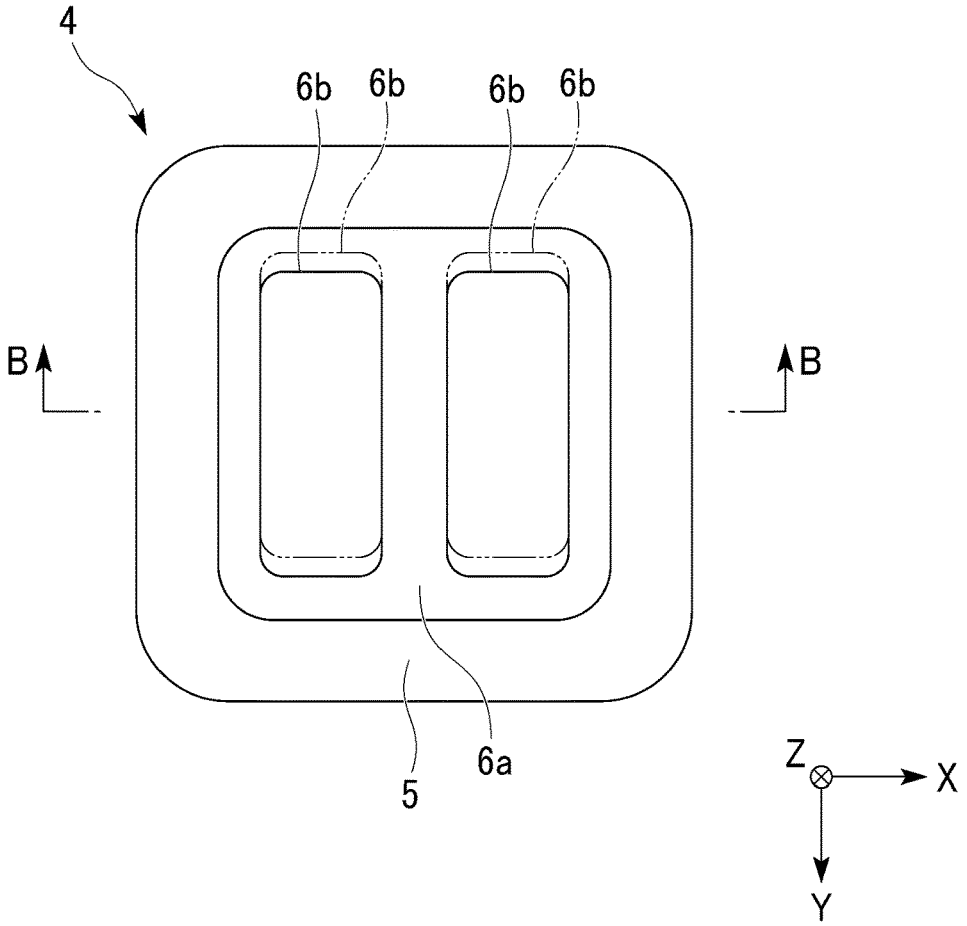
FIG. 6 is a perspective plan view showing the arrangement of the first electrode and the second electrodes of the thermistor element shown in FIG. 5.
Figure 7:
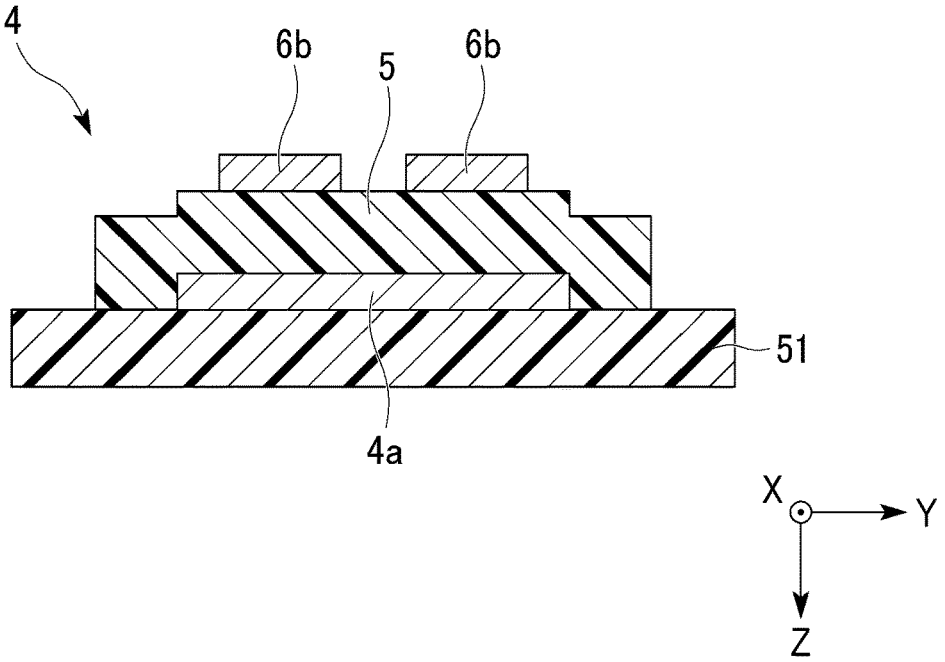
FIG. 7 is a cross-sectional view of the thermistor element with line segment BB shown in FIG. 6.

Note that FIG. 4 is a plan view showing the configuration of the thermistor element 4. FIG. 5 is a cross-sectional view of the thermistor element 4 by the line segments AA shown in FIG. 4. FIG. 6 is a perspective plan view showing the arrangement of the first electrode 6*a* and the second electrodes 6*b* of the thermistor element 4. FIG. 7 is a cross-sectional view of the thermistor element 4 by the line segment BB shown in FIG. 6.

The thermistor element 4 of the present embodiment has a CPP structure, which has a thermistor film 5, a first electrode 6*a* provided in contact with one surface of the thermistor film 5 (the lower surface in FIGS. 5 and 7), and a pair of second electrodes 6*b* provided in contact with the other surface of the thermistor film 5 (the upper surface in FIGS. 5 and 7).

In the thermistor element 4 of the present embodiment, for example, as the thermistor film 5, an oxide having a spinel-type crystal structure containing cobalt, manganese, and nickel (hereinafter referred to as "Co—Mn—Ni oxide") is used, and as the first electrode 6*a* and the second electrodes 6*b*, platinum (Pt) is used. The thermistor element 4 having the above-described configuration is an element called NTC (Negative Temperature Coefficient) whose electrical resistance decreases as the temperature rises.

In the thermistor element 4 of the present embodiment having the above-described configuration, current can from one of the second electrodes 6*b* toward the first electrode 6*a* in the direction perpendicular to the surface of the thermistor film 5, while current flow from the thermistor film 5 toward the other second electrode 6*b* in the direction perpendicular to the surface of the thermistor film 5.

The resistance value of the thermistor film 5 depends on the thickness of the thermistor film 5 and the size of the facing area between the first electrode 6*a* and the second electrodes 6*b*. Therefore, by adopting the above-described CPP structure, it is possible to reduce the resistance of the thermistor film 5.

In the thermistor element 4 of the present embodiment, as shown in FIGS. 6 and 7, the thermistor film 5 is provided to cover the periphery of the first electrode 6*a*. In other words, in the plan view, the region E1 where the first electrode 6*a* contacts the thermistor film 5, locates within the region occupied by the thermistor element 5 in the thermistor element 4.

As a result, in the thermistor element 4 of the present embodiment, it is possible to prevent a short circuit (short path) from occurring between the first electrode 6*a* and the second electrodes 6*b*, and to appropriately flow current in the direction perpendicular to the surface of the thermistor film 5.

On the other hand, when the first electrode 6*a* and the thermistor film 5 have the same shape (same size) in a plan view, a re-deposition of the first electrode 6*a* is formed at the end of the thermistor film 5 in simultaneous patterning the first electrode 6*a* and the thermistor film 5. In this case, a short circuit occurs between the first electrode 6*a* and the second electrode 6*b* via the re-deposition with the end of the thermistor film 5 interposed therebetween. Therefore, the current cannot be appropriately flown in the direction perpendicular to the surface of the thermistor film 5. Therefore, in this case, the thermistor element 4 does not function.

Further, in the thermistor element 4 of the present embodiment, in a plan view, each of the regions E2 where the pair of the second electrodes 6*b* contacts the thermistor film 5, locates within the region E1 where the first electrode 6*a* contacts the thermistor film 5.

As a result, in the thermistor element 4 of the present embodiment, even if the arrangement of the pair of second electrodes 6*b* in the plane varies (indicated by the broken line in FIG. 6), the facing area between the first electrode 6*a* and the second electrode 6*b* does not change. Accordingly, it possible to suppress variations in the resistance value of the thermistor film 5.

In this embodiment, the case where the thermistor film 5, the first electrode 6*a*, and the second electrode 6*b* are formed in a substantially rectangular shape in a plan view is illustrated. However, the shapes of the thermistor film 5, the first electrode 6*a*, and the second electrode 6*b* can be changed as appropriate.

Next, the manufacturing process of the thermistor element 4 is described with reference to FIGS. 8 to 11.

FIGS. 8 to 11 are cross-sectional views for sequentially explaining the manufacturing process of the thermistor element 4.

Figure 8:
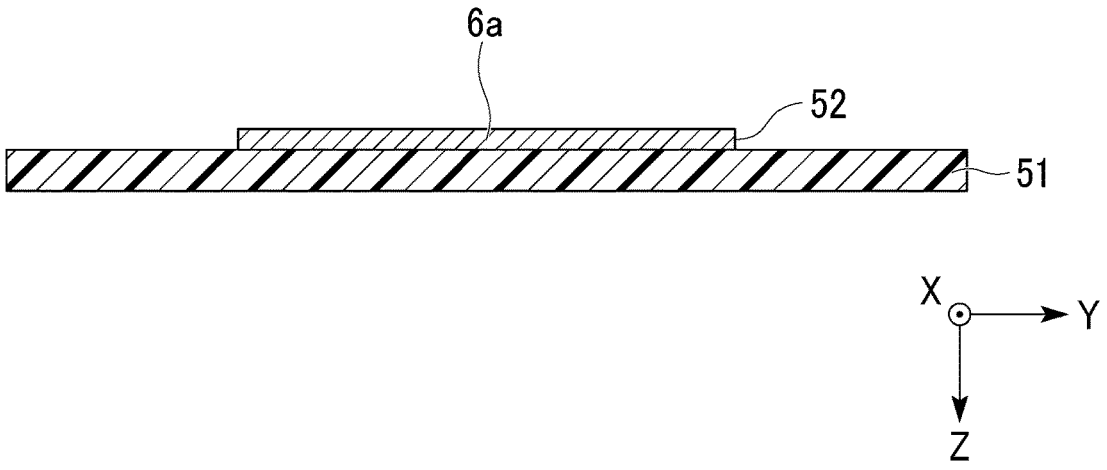
FIG. 8 is a cross-sectional view for sequentially explaining the manufacturing process of the thermistor element shown in FIG. 7.

When manufacturing the thermistor element 4, first, a Pt film 52 is formed over the entire surface on the surface of the $SiO_2$ film 51 which is a part of the dielectric film 7. The first electrode 6*a* is formed by patterning the Pt film 52 using a photolithography technique as shown in FIG. 8. A Ta film may be interposed between the $SiO_2$ film 51 and the Pt film 52 in order to improve the adhesion.

Figure 9:
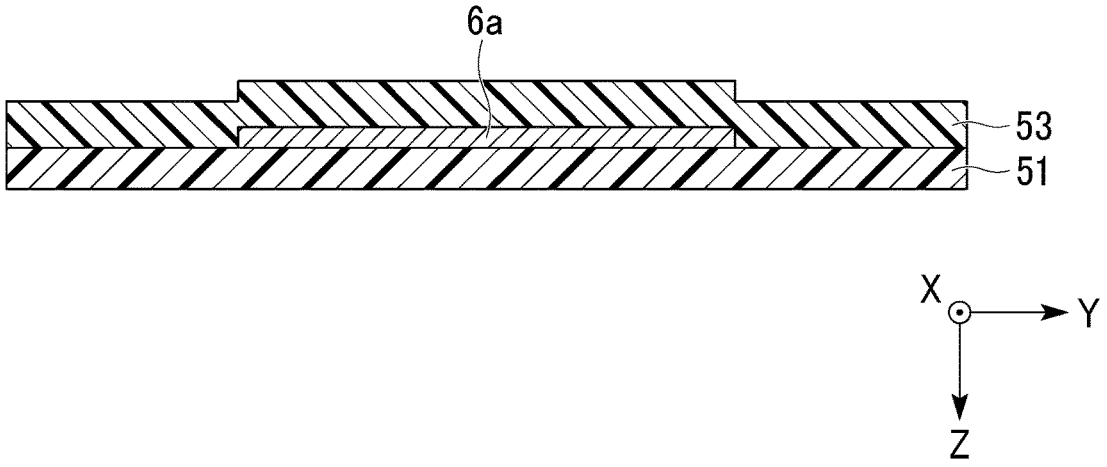
FIG. 9 is a cross-sectional view for sequentially explaining the manufacturing process of the thermistor element shown in FIG. 7.

Next, as shown in FIG. 9, a Co—Mn—Ni oxide film 53 is formed over the entire surface.

Figure 10:
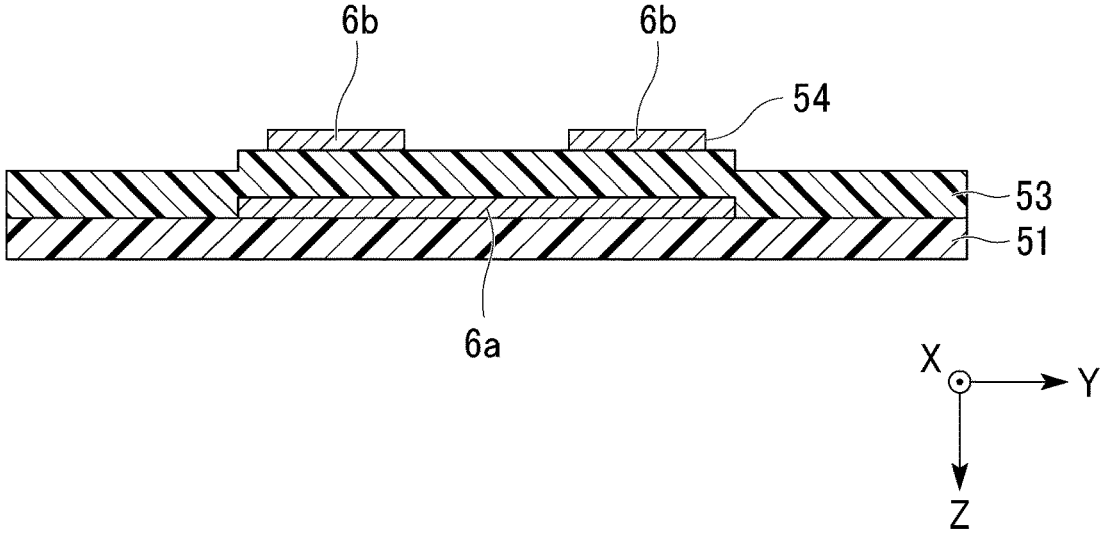
FIG. 10 is a cross-sectional view for sequentially explaining the manufacturing process of the thermistor element shown in FIG. 7.

Next, a Pt film 54 is formed over the entire surface of the Co—Mn—Ni oxide film 53. A pair of second electrodes 6*b* is formed by patterning the Pt film 54 using a photolithography technique as shown in FIG. 10. The pair of second electrodes 6*b* is formed so as to be located inside the first electrode 6*a* in a plan view.

Figure 11:
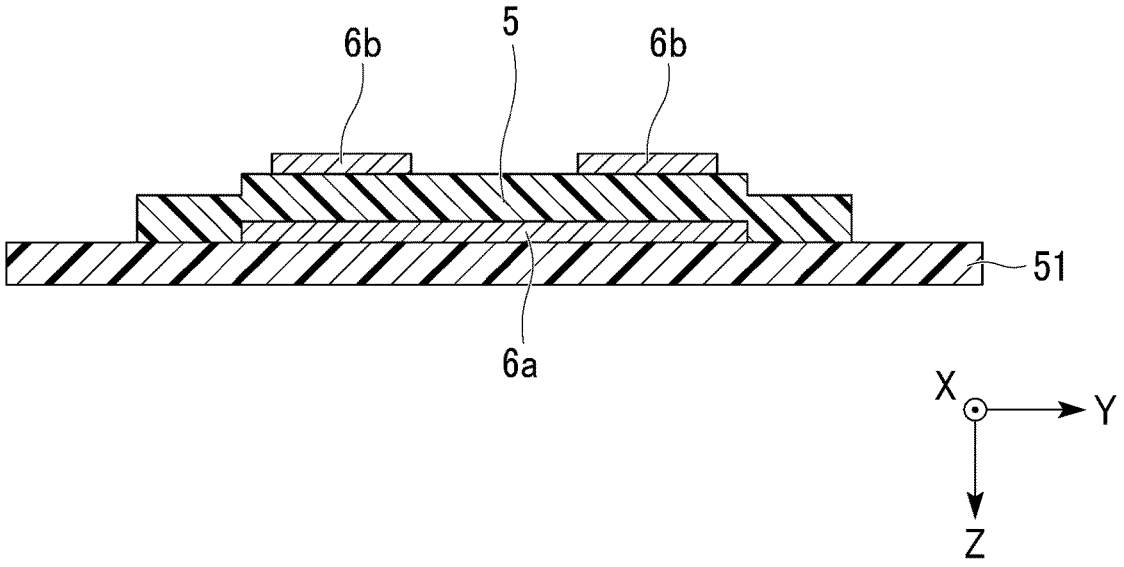
FIG. 11 is a cross-sectional view for sequentially explaining the manufacturing process of the thermistor element shown in FIG. 7.

Next, as shown in FIG. 11, by patterning the Co—Mn—Ni oxide film 53 using a photolithography technique, the thermistor film 5 is formed so as to cover the periphery of the first electrode 6*a*. By going through the above-described steps, the thermistor element 4 can be manufactured.

In the manufacturing process of the thermistor element 4, it is possible to prevent the re-deposition of the first electrode 6*a* from being formed at the end of the thermistor film 5. Therefore, in the thermistor element 4 of the present embodiment, it is possible to prevent a short circuit (short path) from occurring between the first electrode 6*a* and the second electrode 6*b* via the re-deposition.

In the electromagnetic wave sensor 1, the reliability can be improved by using the thermistor element 4 of the present embodiment.

Second Embodiment

Figure 12:
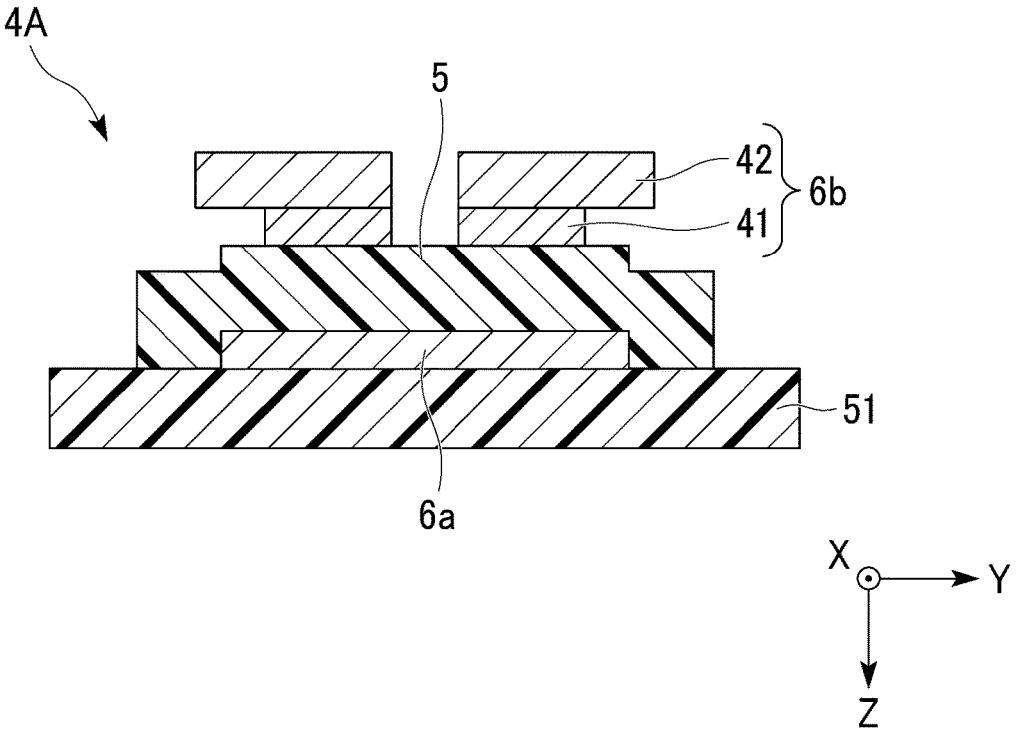
FIG. 12 is a cross-sectional view showing a configuration of a thermistor element according to a second embodiment of the present disclosure.

Next, as a second embodiment of the present disclosure, the thermistor element 4A shown in FIG. 12 is described, for example.

Note that FIG. 12 is a cross-sectional view showing the configuration of the thermistor element 4A. Further, in the following description, the same parts as those of the thermistor element 4 will be omitted and the same reference numerals will be given in the drawings.

As shown in FIG. 12, the thermistor element 4A of the present embodiment has a pair of the second electrodes 6*b*, each of which has a two-layered structure. In the two-layered structure, the first conductive layer 41 and the second conductive layer 42 are laminated on the thermistor film 5 in the order. Other than that, it has basically the same configuration as the thermistor element 4.

The first conductive layer 41 is made of an alloy containing one or more selected from: platinum (Pt), gold (Pu), palladium (Pd), ruthenium (Ru), silver (Ag), rhodium (Rh), iridium (Ir), and osmium (Os).

The second conductive layer 42 is made of at least one selected from: aluminum (Al), tungsten (W), titanium (Ti), tantalum (Ta), titanium nitride (TiN), tantalum nitride (TaN), chromium nitride (TaCr), and zirconium nitride (ZrN).

Specifically, the manufacturing process of the thermistor element 4A is described with reference to FIGS. 13 to 23.

FIGS. 13 to 23 are cross-sectional views for sequentially explaining the manufacturing process of the thermistor element 4A.

Figure 13:
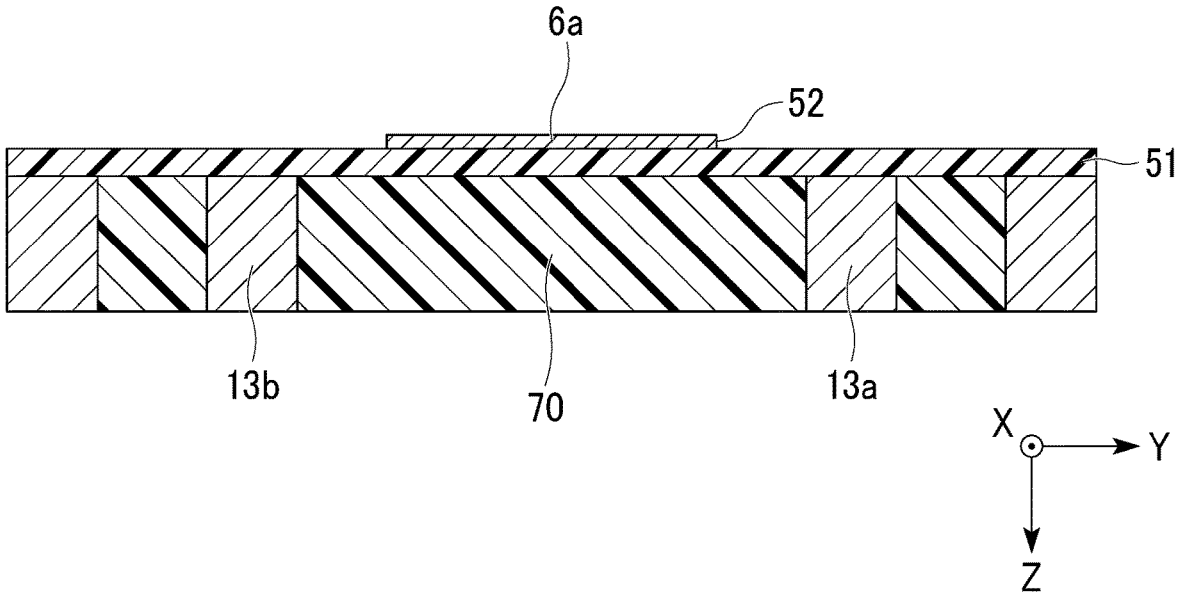
FIG. 13 is a cross-sectional view for sequentially explaining the manufacturing process of the thermistor element shown in FIG. 12.

When manufacturing the thermistor element 4A, first, a Pt film 52 is formed over the entire surface as a film to be the first conductive layer 41 on the surface of the $SiO_2$ film 51 that is a part of the dielectric film 7, for example. Then, the first electrode 6*a* is formed by patterning the Pt film 52 using a photolithography technique as shown in FIG. 13.

The pair of leg parts 13*a* and 13*b* of the electromagnetic wave sensor 1 are embedded in the cured organic material layer 70 under the $SiO_2$ film 51.

Figure 14:
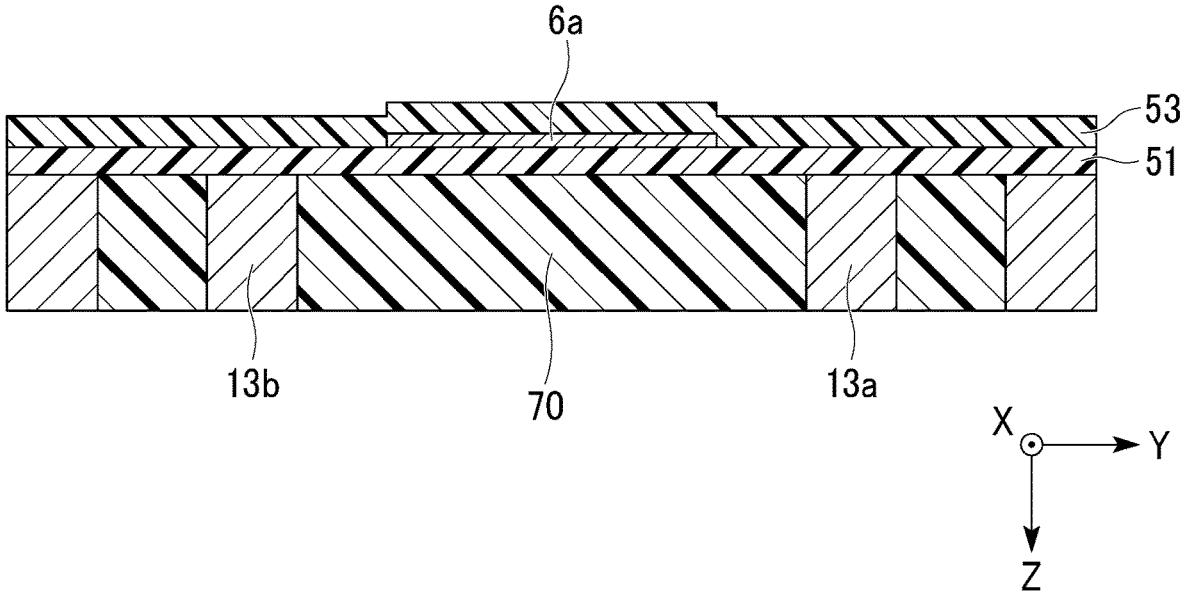
FIG. 14 is a cross-sectional view for sequentially explaining the manufacturing process of the thermistor element shown in FIG. 12.

Next, as shown in FIG. 14, a Co—Mn—Ni oxide film 53 is formed over the entire surface.

Figure 15:
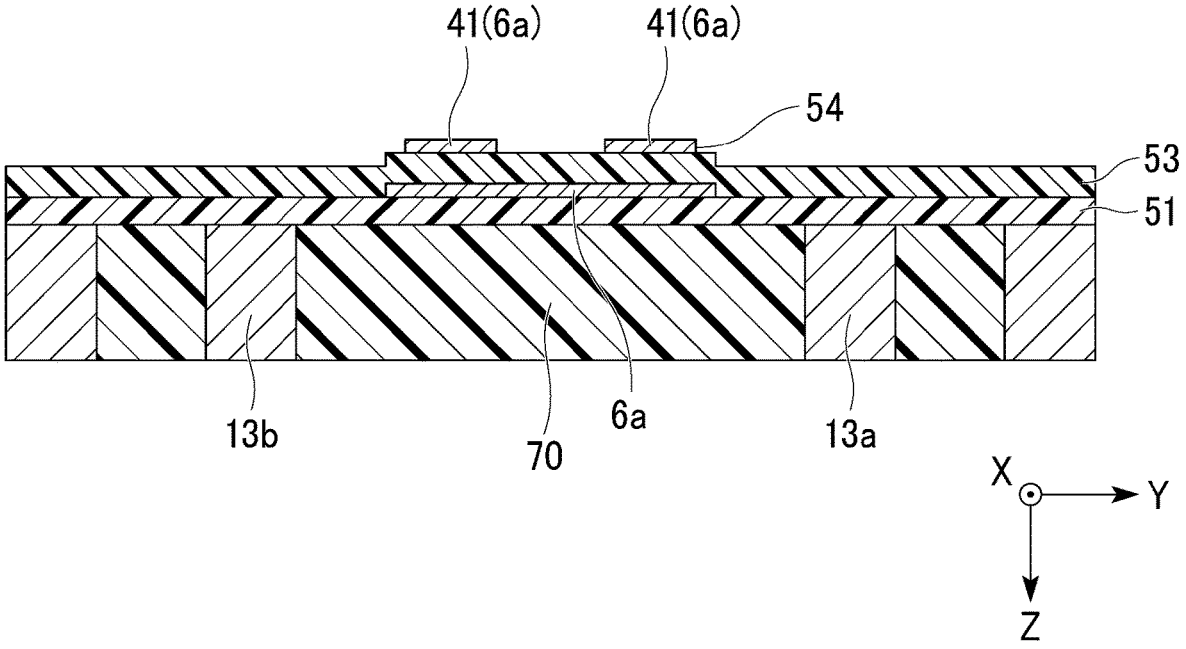
FIG. 15 is a cross-sectional view for sequentially explaining the manufacturing process of the thermistor element shown in FIG. 12.

Next, a Pt film 54 is formed over the entire surface on the Co—Mn—Ni oxide film 53. A pair of first conductive layers 41 serving as a pair of second electrodes 6*b* is formed by patterning the Pt film 54 using a photolithography technique as shown in FIG. 15. The pair of first conductive layers 41 is formed so as to be located in the region occupied by the first electrode 6*a* in the plan view.

Figure 16:
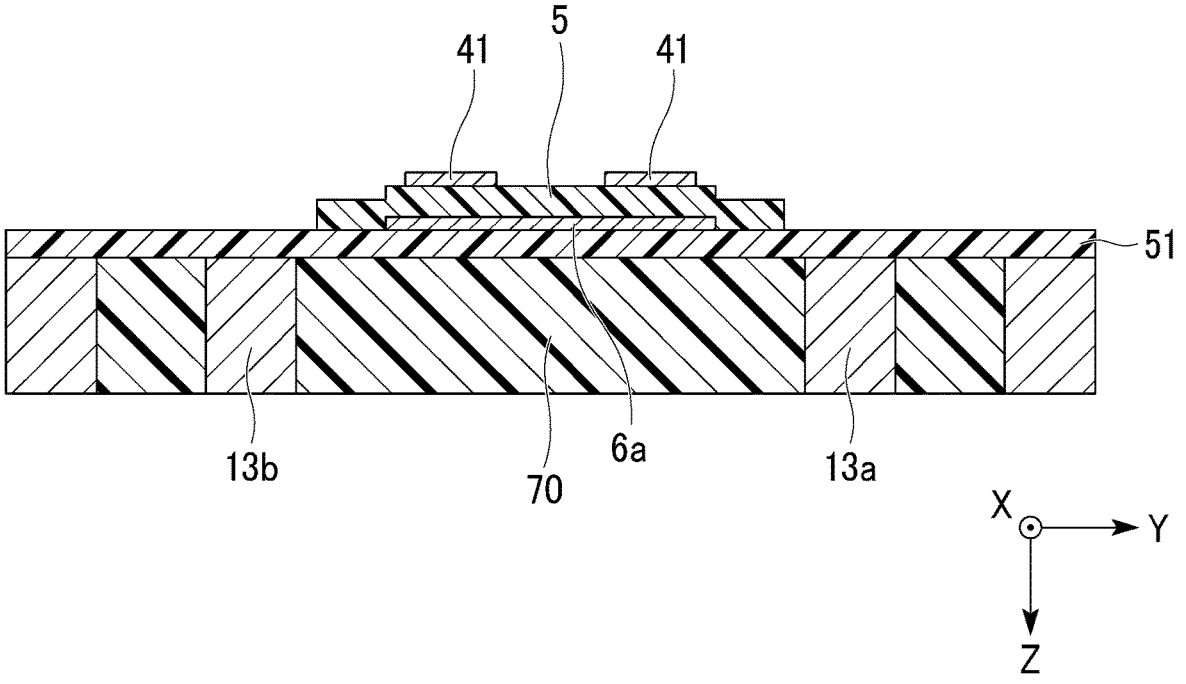
FIG. 16 is a cross-sectional view for sequentially explaining the manufacturing process of the thermistor element shown in FIG. 12.

Next, as shown in FIG. 16, by patterning the Co—Mn—Ni oxide film 53 using a photolithography technique, the thermistor film 5 is formed so as to cover the periphery of the first electrode 6*a*.

Figure 17:
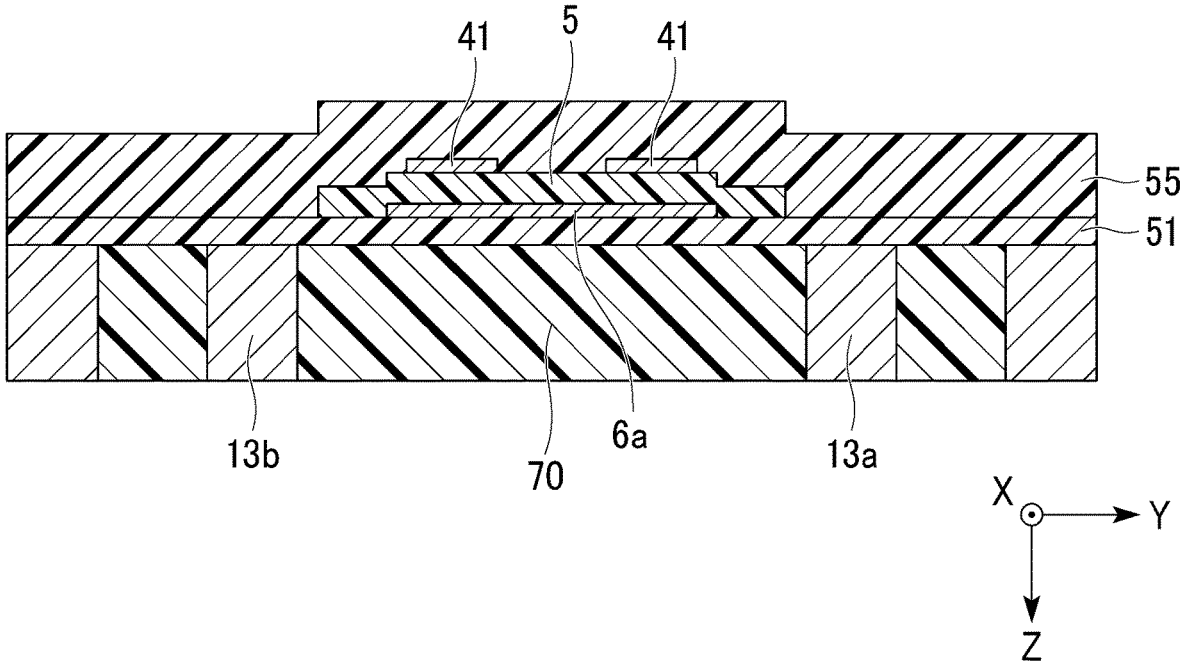
FIG. 17 is a cross-sectional view for sequentially explaining the manufacturing process of the thermistor element shown in FIG. 12.

Next, as shown in FIG. 17, the $SiO_2$ film 55 is formed over the entire surface.

Figure 18:
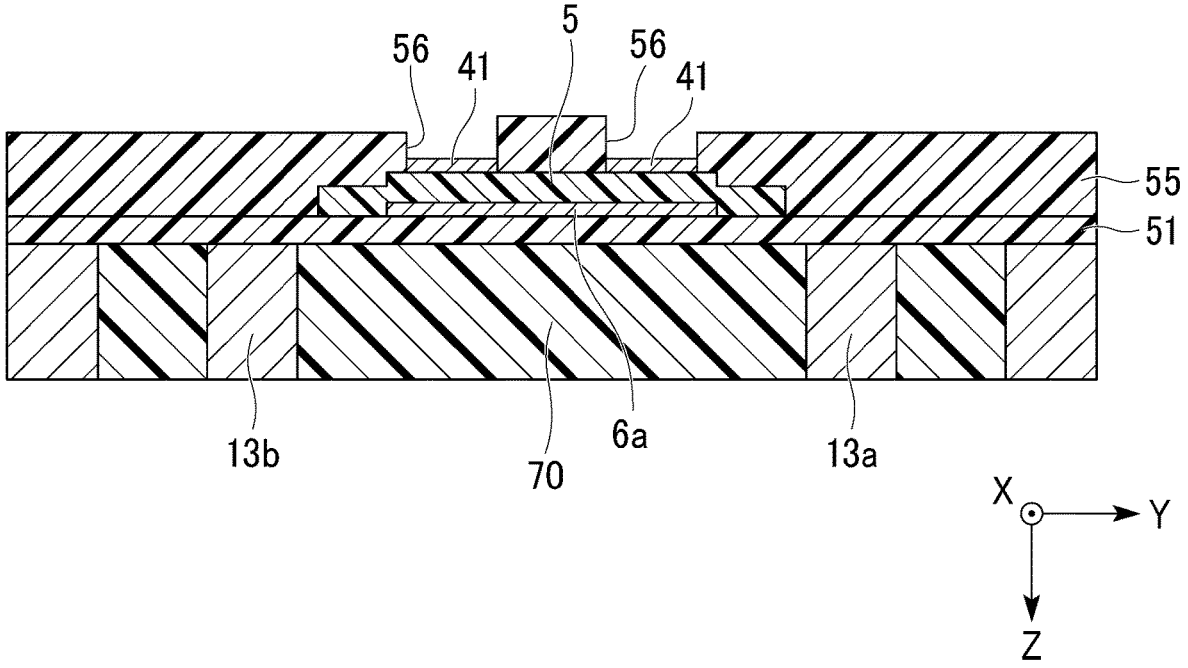
FIG. 18 is a cross-sectional view for sequentially explaining the manufacturing process of the thermistor element shown in FIG. 12.

Next, as shown in FIG. 18, a pair of holes 56 penetrating the $SiO_2$ film 55 are formed on the pair of first conductive layers 41. When forming a pair of holes 56, a mask layer (not shown) having an opening at a position corresponding to each hole 56 is formed on the surface of the $SiO_2$ film 55. Then, reactive ion etching (RIE) using a chlorine-based gas is performed. At this time, the first conductive layer 41 made of the above-described material can function as an etching stopper.

Figure 19:
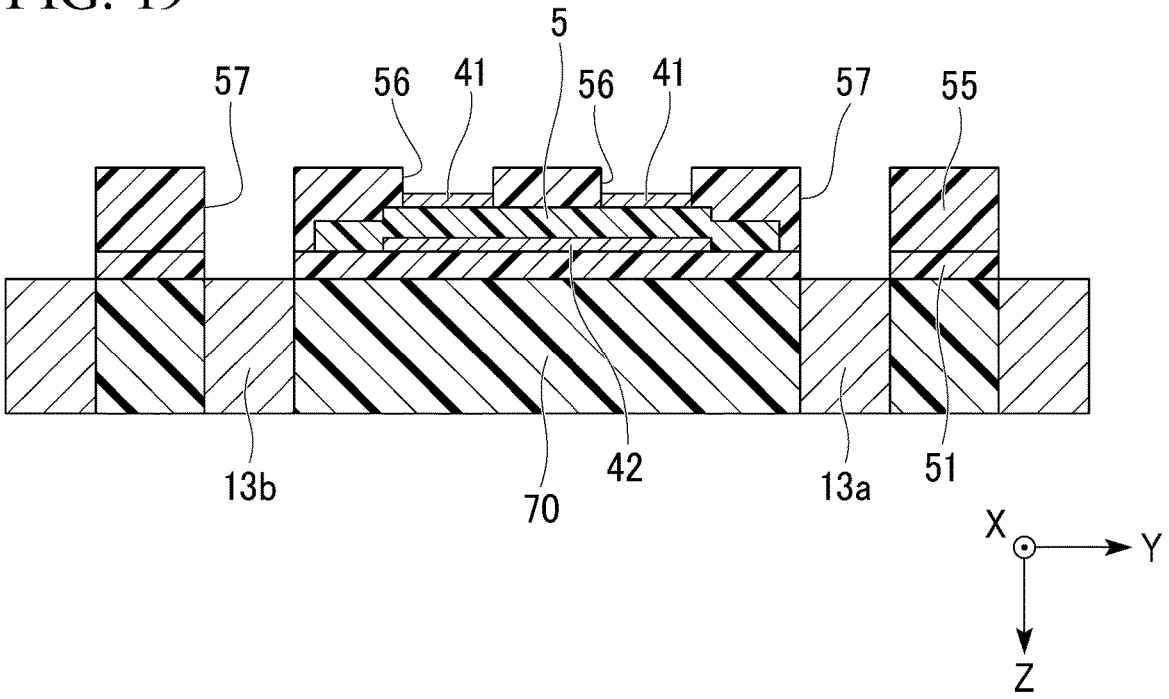
FIG. 19 is a cross-sectional view for sequentially explaining the manufacturing process of the thermistor element shown in FIG. 12.

Next, as shown in FIG. 19, a pair of hole portions 57 penetrating the $SiO_2$ films 55 and 51 are formed on the pair of leg parts 13*a* and 13*b*.

Figure 20:
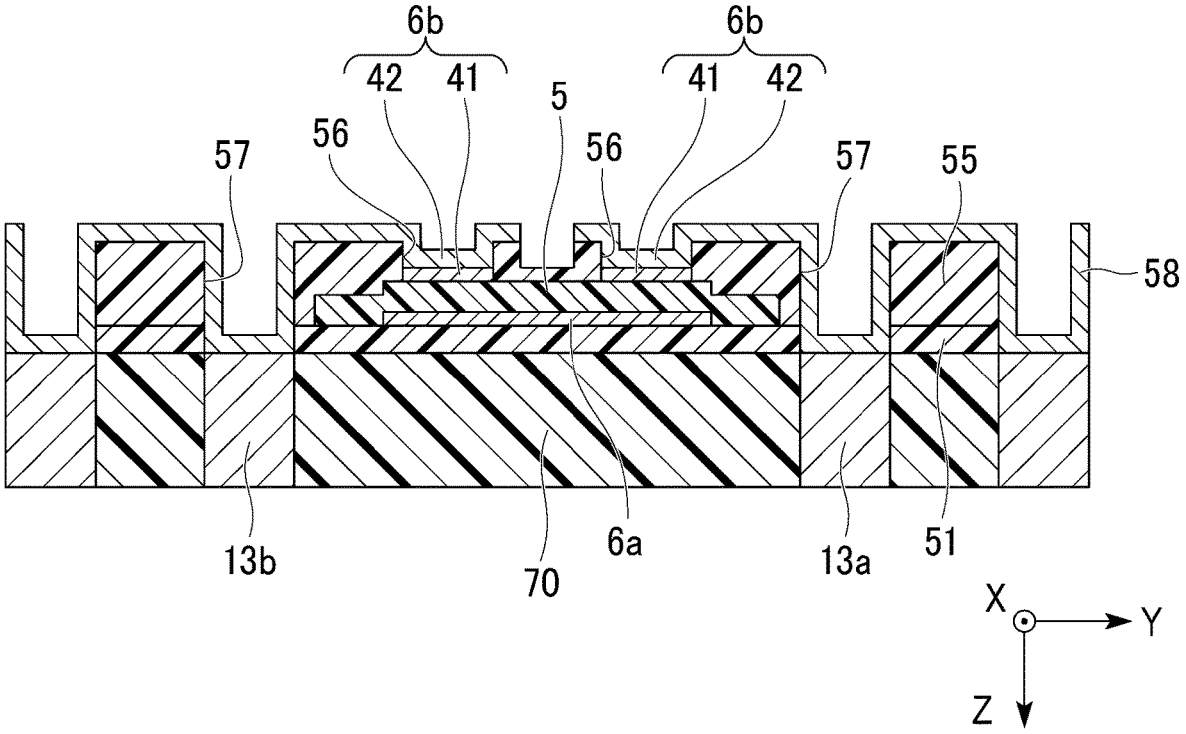
FIG. 20 is a cross-sectional view for sequentially explaining the manufacturing process of the thermistor element shown in FIG. 12.

Next, as shown in FIG. 20, a Ti film 58 forming the second conductive layer 42 and the arm parts 12*a* and 12*b* is formed over the entire surface, and then patterned using photolithography technology. As a result, the second electrodes 6*b* in which the first conductive layer 41 and the second conductive layer 42 are laminated in this order are formed.

Figure 21:
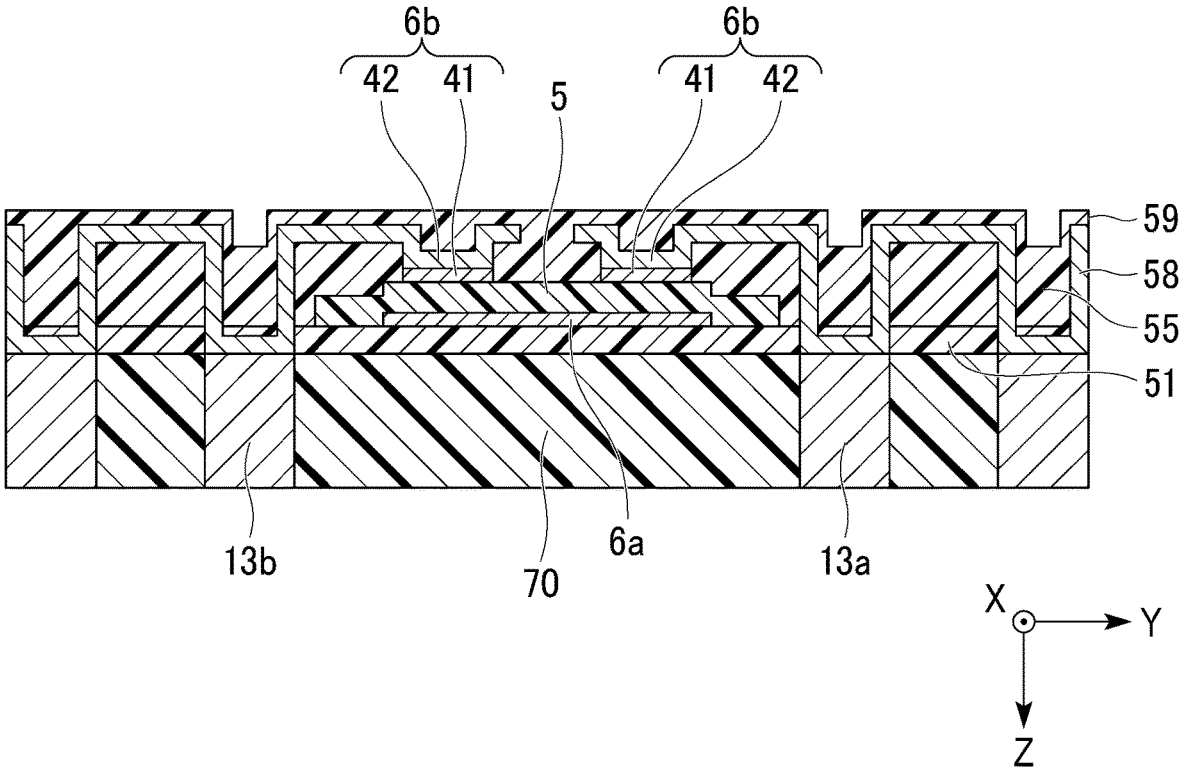
FIG. 21 is a cross-sectional view for sequentially explaining the manufacturing process of the thermistor element shown in FIG. 12.

Next, as shown in FIG. 21, the $SiO_2$ film 59 is formed over the entire surface.

Figure 22:
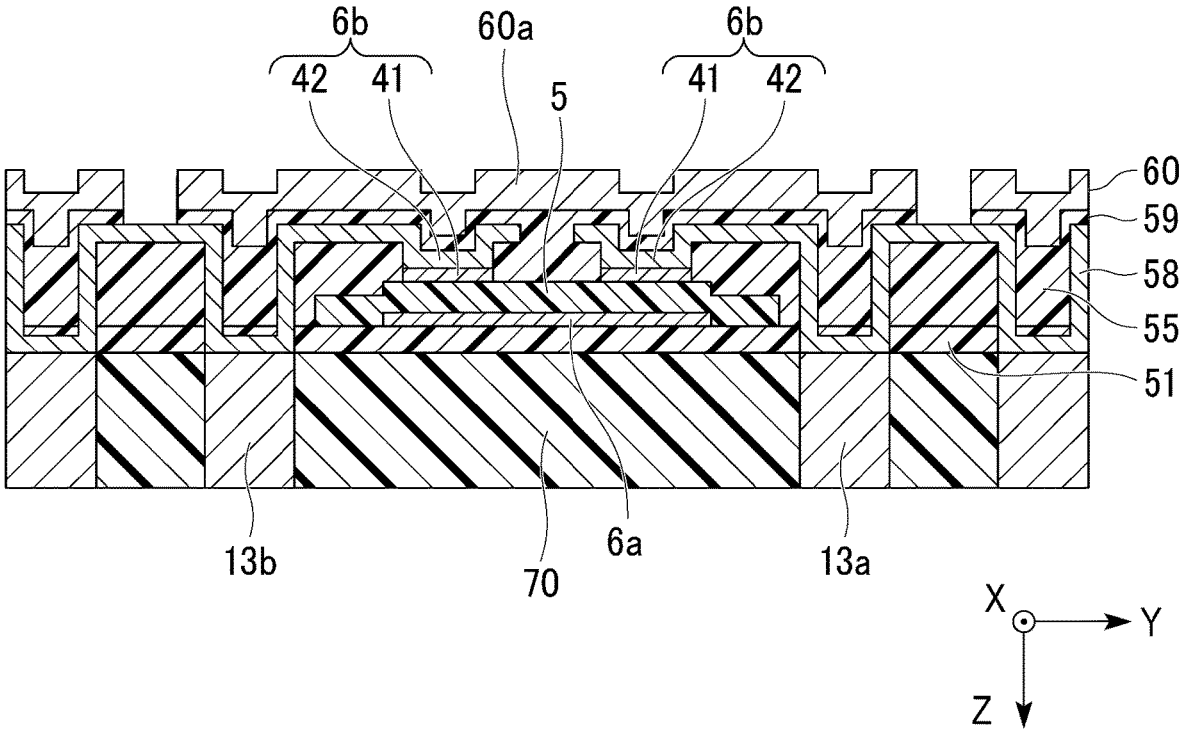
FIG. 22 is a cross-sectional view for sequentially explaining the manufacturing process of the thermistor element shown in FIG. 12.

Next, a NiCr film 60 is formed over the entire surface. A mask layer 60*a* having a shape corresponding to the pair of arm parts 12*a* and 12*b* of the electromagnetic wave sensor 1 is formed by patterning the NiCr film 60 using a photolithography technique as shown in FIG. 22.

Figure 23:
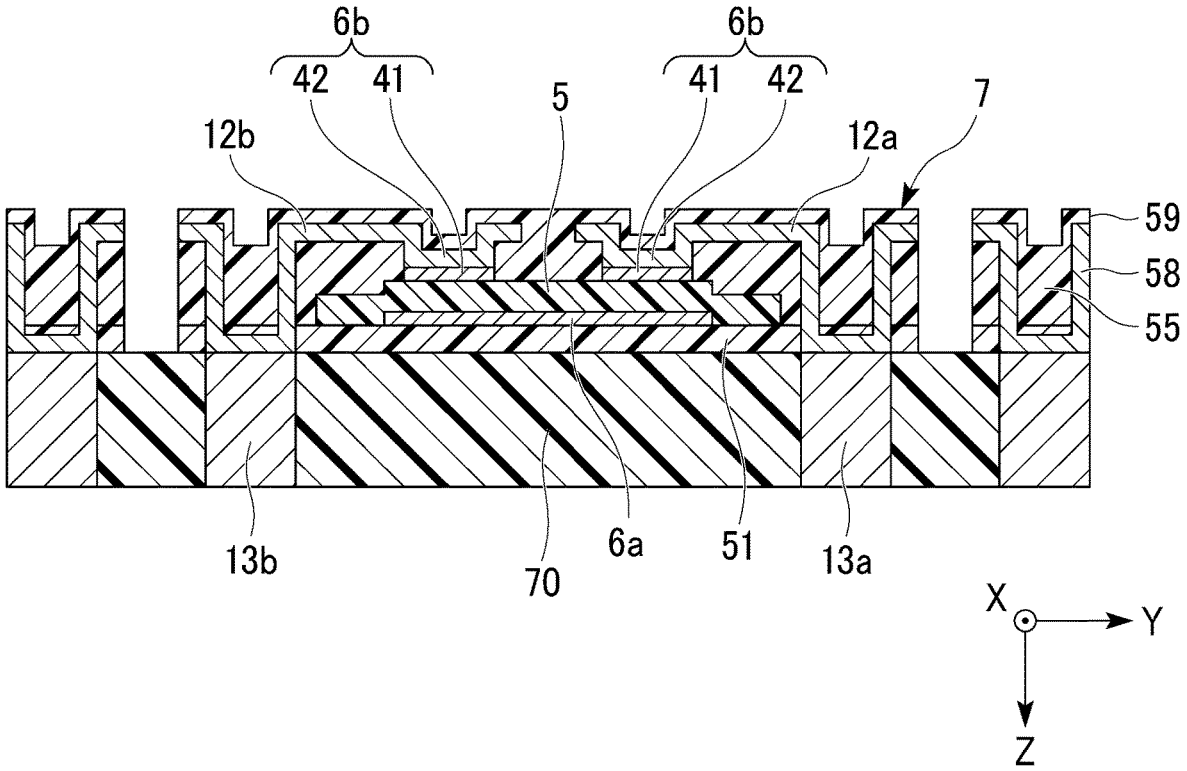
FIG. 23 is a cross-sectional view for sequentially explaining the manufacturing process of the thermistor element shown in FIG. 12.

Next, as shown in FIG. 23, reactive ion etching (RIE) using a chlorine-based gas is performed. At this time, the Ti film 58 and the $SiO_2$ films 59, 55, 51 are removed while patterning until the organic material layer 70 is exposed. Then, the mask layer 60*a* is removed from the surface of the $SiO_2$ film 59. As a result, a pair of arm parts 12*a* and 12*b* are formed.

By going through the above-described processes, the thermistor element 4A can be manufactured.

In the manufacturing process of the thermistor element 4A, the above-described conductive material (Pt film 54 in the present embodiment), which is unlikely to cause atomic diffusion into the thermistor film 5, is used for the above-described first conductive layer 41. This makes it possible to suppress deterioration of the characteristics of the thermistor film 5.

On the other hand, the above-described conductive material (Ti film 58 in this embodiment) is used for the second conductive layer 42. When this conductive material is used, it becomes possible to etch the second conductive layer 42 together with the $SiO_2$ films 59, 55, 51 by reactive ion etching (RIE) using a chlorine-based gas. As a result, the pair of arm parts 12*a* and 12*b* can be easily patterned.

In the electromagnetic wave sensor 1, the thermistor element 4A of the present embodiment can be used instead of the thermistor element 4. In the electromagnetic wave sensor 1, the reliability can be improved by using the thermistor element 4A of the present embodiment.

Third Embodiment

Figure 24:
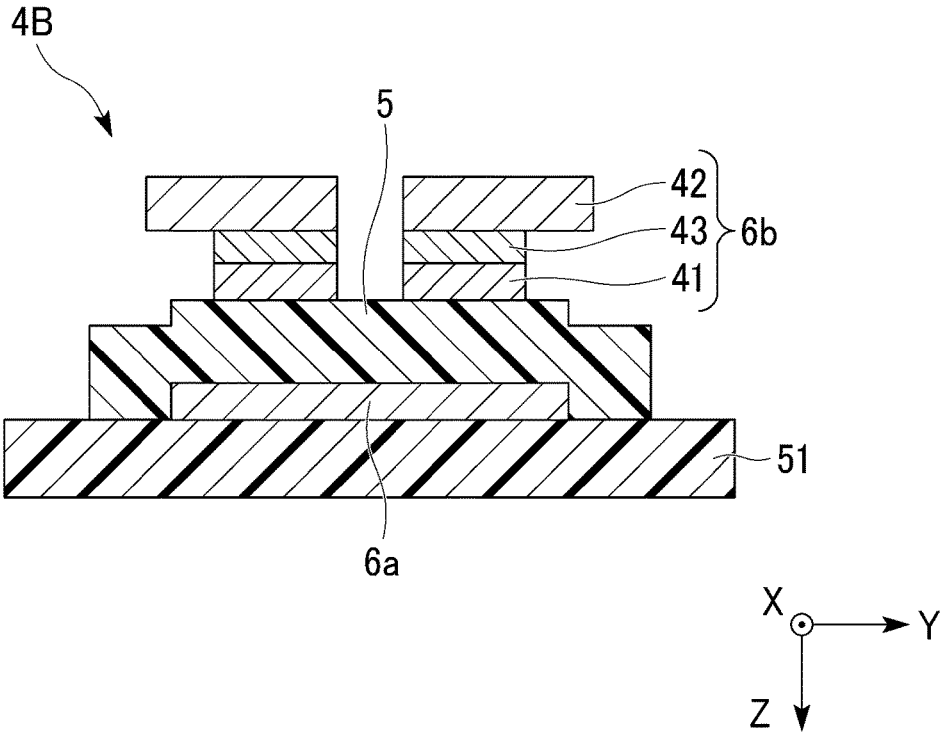
FIG. 24 is a cross-sectional view showing a configuration of a thermistor element according to a third embodiment of the present disclosure.

Next, as a third embodiment of the present disclosure, the thermistor element 4B shown in FIG. 24 is described, for example.

Note that FIG. 24 is a cross-sectional view showing the configuration of the thermistor element 4B. Further, in the following description, the same parts as those of the thermistor element 4A will be omitted and the same reference numerals will be given in the drawings.

Figure 25:
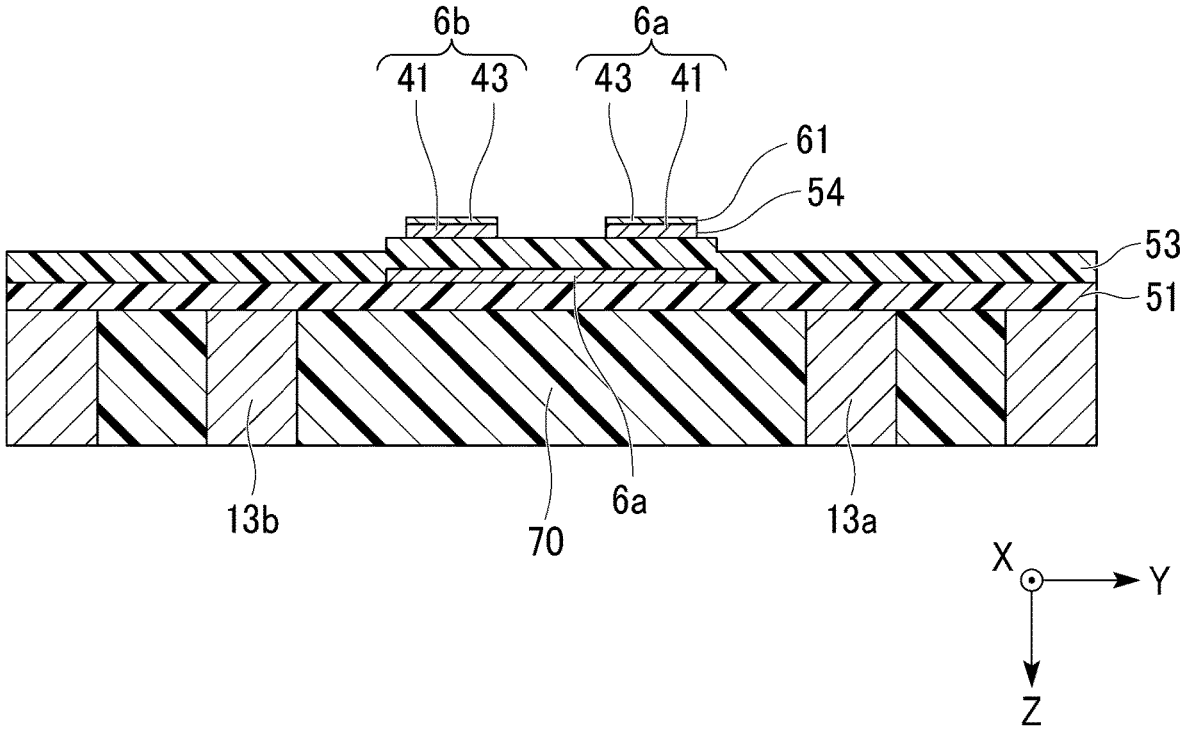
FIG. 25 is a cross-sectional view for sequentially explaining the manufacturing process of the thermistor element shown in FIG. 24.

As shown in FIG. 25, the thermistor element 4B of the present embodiment includes a pair of second electrodes 6*b* having a third conductive layer 43 between the first conductive layer 41 and the second conductive layer 42. In other words, the second electrode 6*b* has a three-layer structure in which the first conductive layer 41, the third conductive layer 43, and the second conductive layer 42 are sequentially laminated on the surface of the thermistor film 5 in the order.

The third conductive layer 43 is made of at least one selected from NiCr alloy, NiFe alloy, and ruthenium (Ru).

Specifically, the manufacturing process of the thermistor element 4B will be described with reference to FIGS. 25 to 32.

FIGS. 25 to 32 are cross-sectional views for sequentially explaining the manufacturing process of the thermistor element 4B.

When manufacturing the thermistor element 4B, the Pt film 54 and the NiCr film 61 are sequentially formed over the entire surface after the process shown in FIGS. 13 and 14. A pair of the first conductive layers 41 made of the Pt film 54 and a pair of the third conductive layers 43 made of the NiCr film 61 are formed by patterning the Pt film 54 and the NiCr film 61 using a photolithography technique as shown in FIG. 25. The pair of the first conductive layer 41 and the pair of the third conductive layer 43 are formed so as to be located in the region occupied by the first electrode 6*a* in a plan view.

Figure 26:
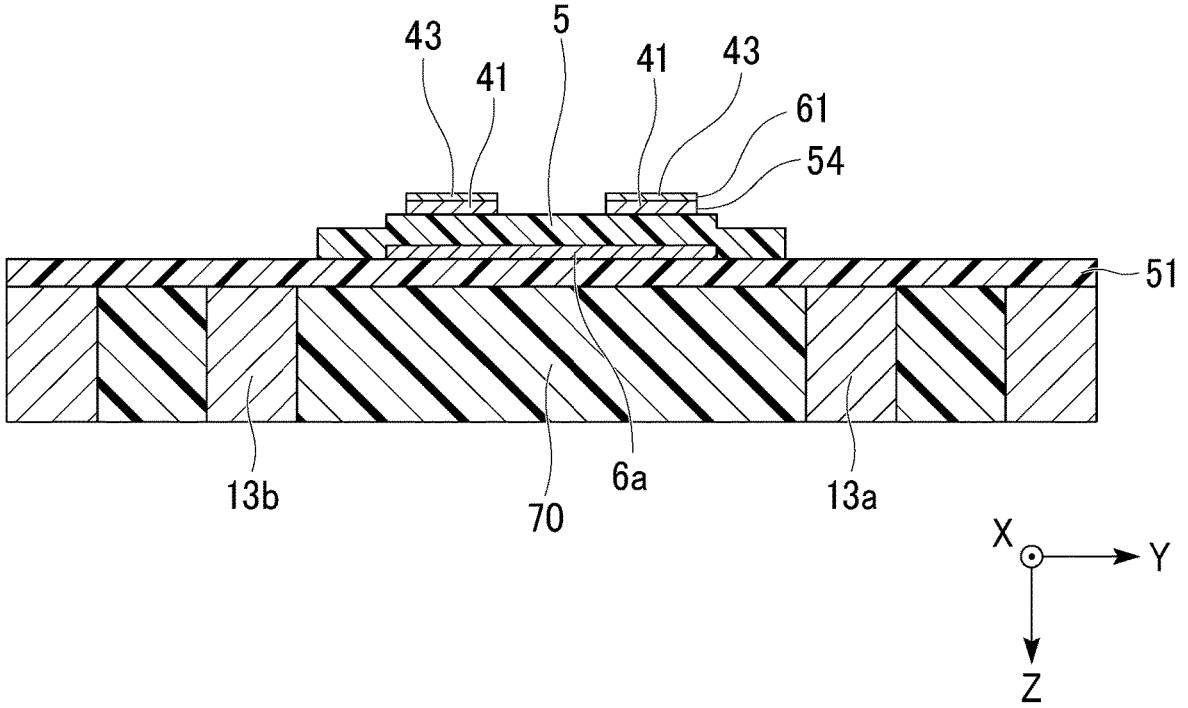
FIG. 26 is a cross-sectional view for sequentially explaining the manufacturing process of the thermistor element shown in FIG. 24.

Next, as shown in FIG. 26, the Co—Mn—Ni oxide film 53 is patterned by using a photolithography technique to form the thermistor film 5 so as to cover the periphery of the first electrode 6*a*.

Figure 27:
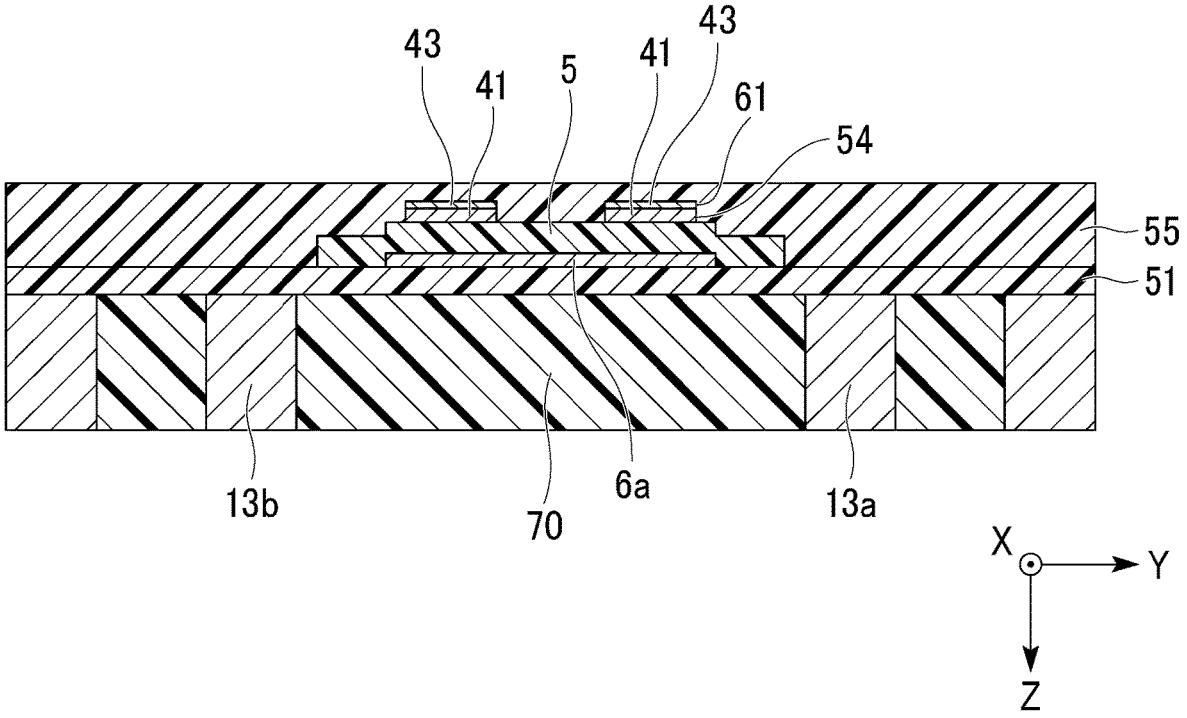
FIG. 27 is a cross-sectional view for sequentially explaining the manufacturing process of the thermistor element shown in FIG. 24.

Next, as shown in FIG. 27, the $SiO_2$ film 55 is formed over the entire surface.

Figure 28:
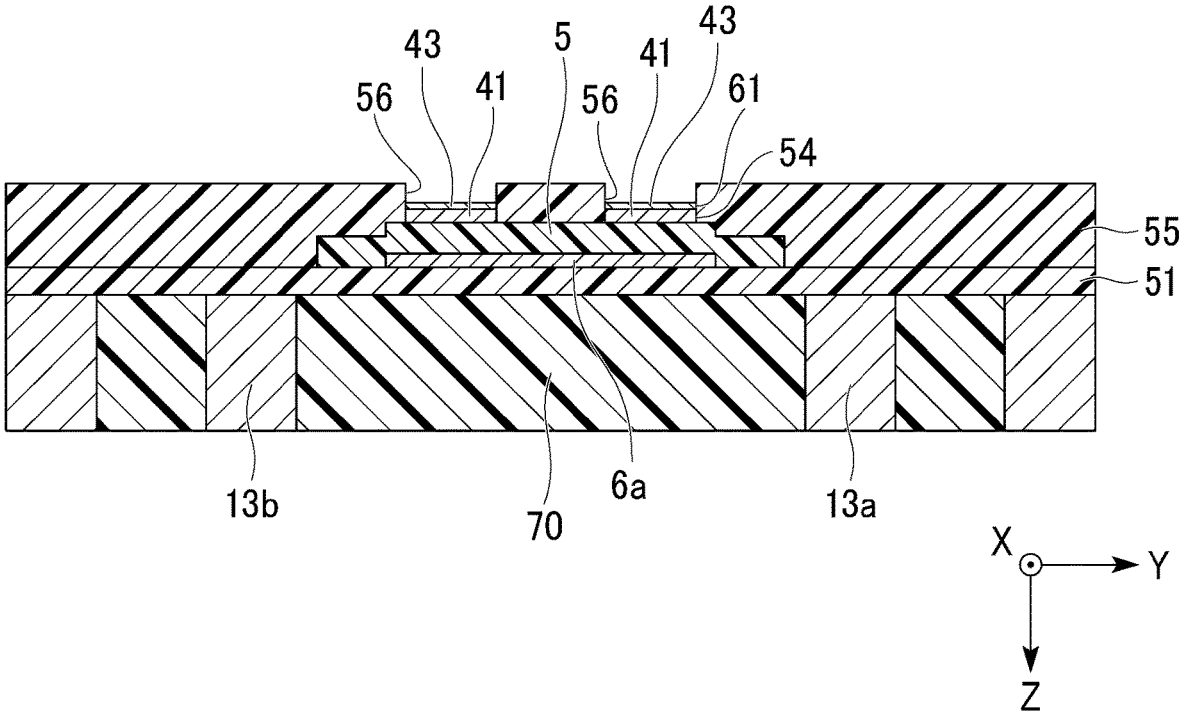
FIG. 28 is a cross-sectional view for sequentially explaining the manufacturing process of the thermistor element shown in FIG. 24.

Next, as shown in FIG. 28, a pair of holes 56 penetrating the $SiO_2$ film 55 is formed on the pair of third conductive layers 44*c*. When forming the pair of pores 56, the reactive ion etching (RIE) using a chlorine-based gas is performed after forming the mask layer (not shown) having openings at positions corresponding to the respective pores 56 on the surface of the $SiO_2$ film 55. At this time, the third conductive layer 44*c* made of the above-described material can function as an etching stopper.

Figure 29:
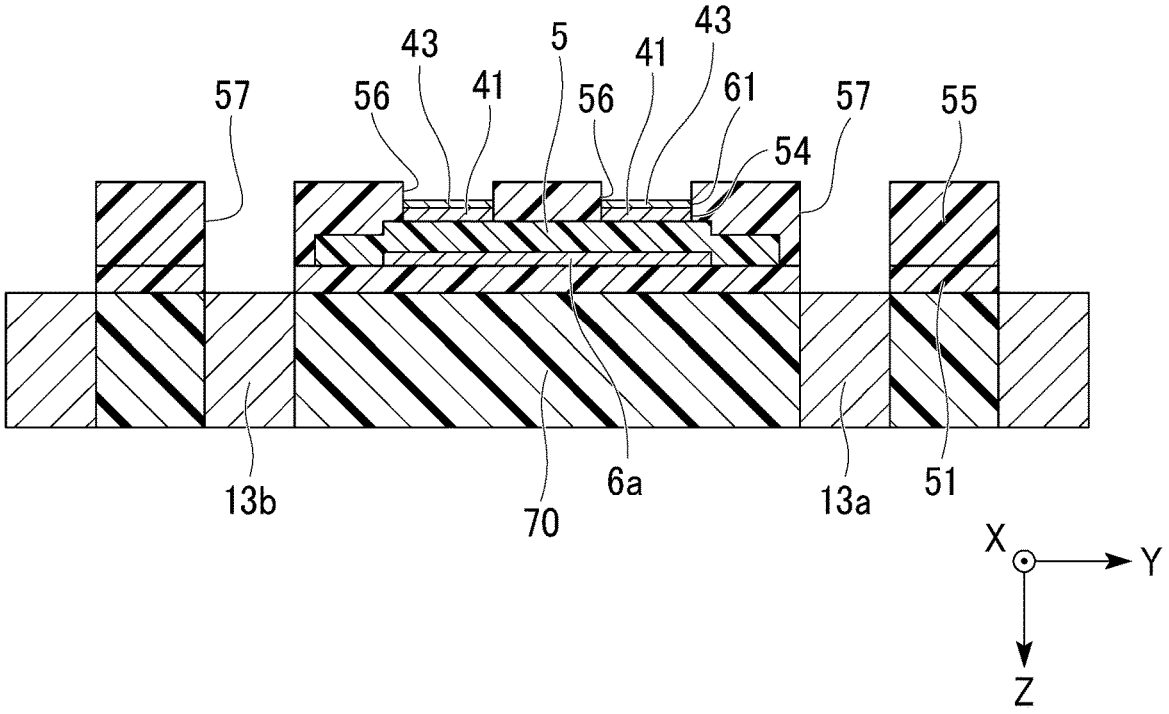
FIG. 29 is a cross-sectional view for sequentially explaining the manufacturing process of the thermistor element shown in FIG. 24.

Next, as shown in FIG. 29, a pair of hole portions 57 penetrating the $SiO_2$ films 55 and 51 are formed on the pair of leg parts 13*a* and 13*b*.

Figure 30:
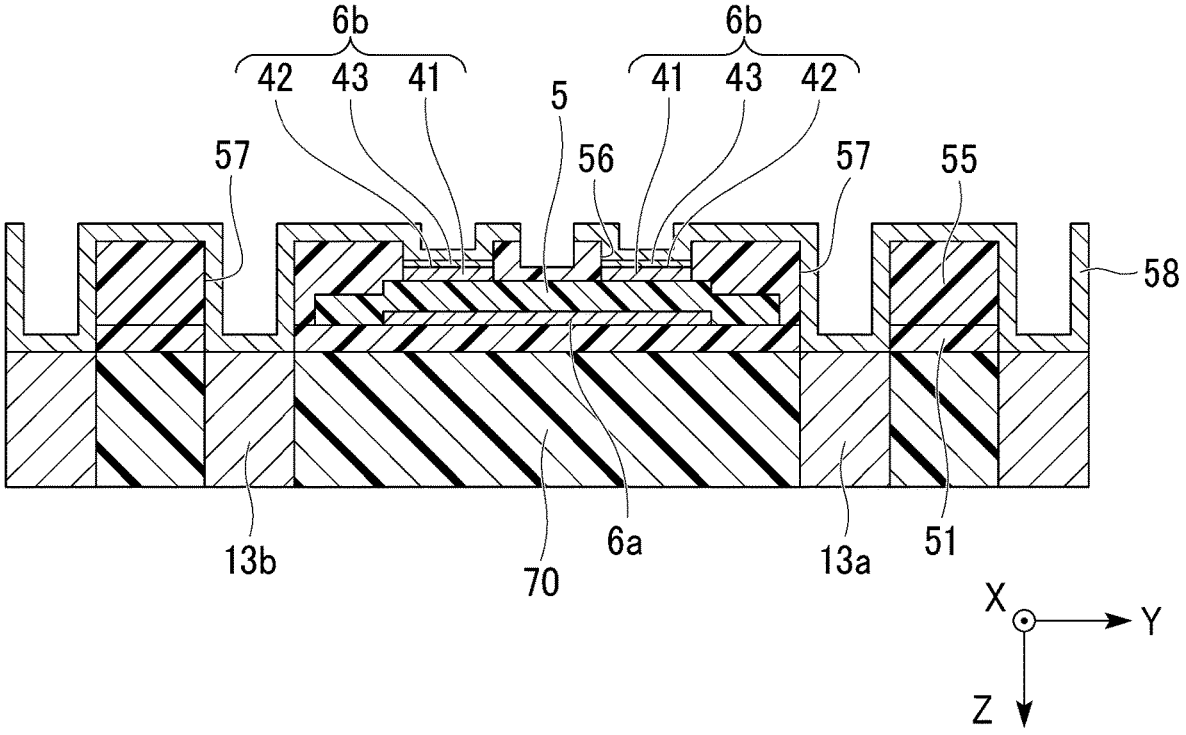
FIG. 30 is a cross-sectional view for sequentially explaining the manufacturing process of the thermistor element shown in FIG. 24.

Next, as shown in FIG. 30, a Ti film 58 forming the second conductive layer 42 and the arm parts 12*a* and 12*b* is formed over the entire surface, and then patterned using a photolithography technique. As a result, the second electrodes 6*b*, in which the first conductive layer 41, the third conductive layer 43, and the second conductive layer 42 are laminated in this order, are formed.

Figure 31:
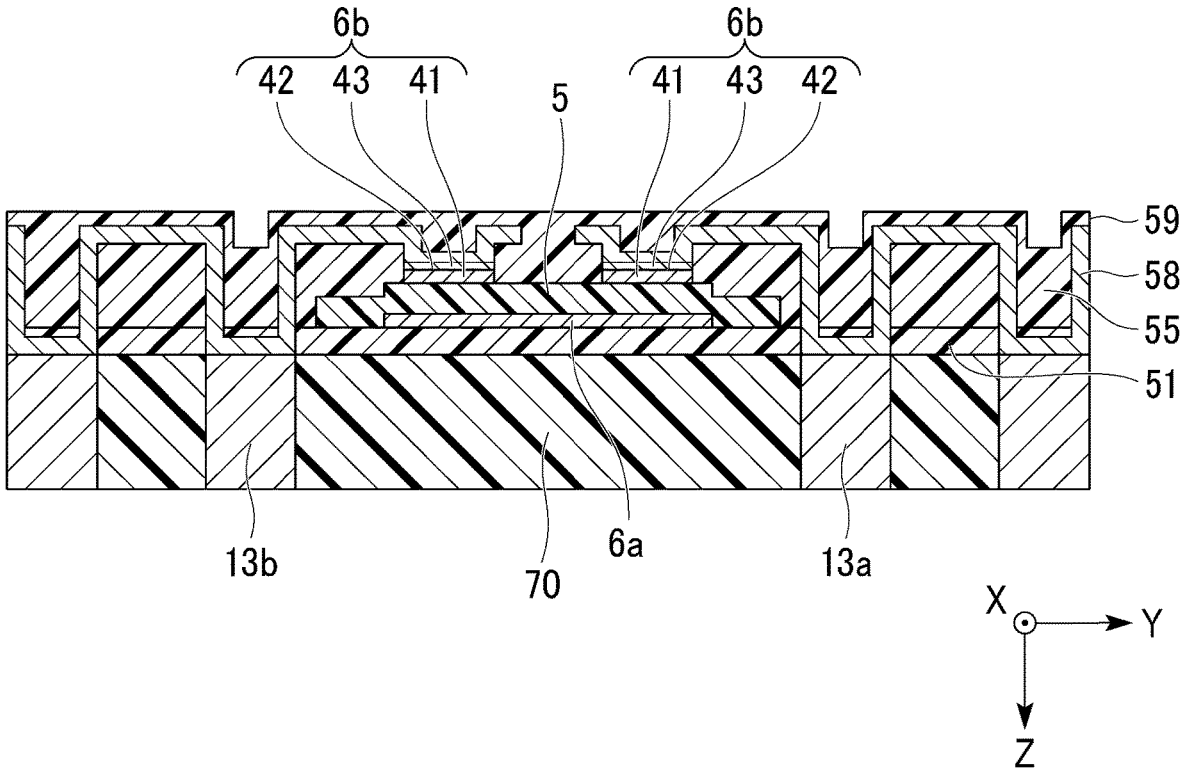
FIG. 31 is a cross-sectional view for sequentially explaining the manufacturing process of the thermistor element shown in FIG. 24.

Next, as shown in FIG. 31, the $SiO_2$ film 59 is formed over the entire surface.

Figure 32:
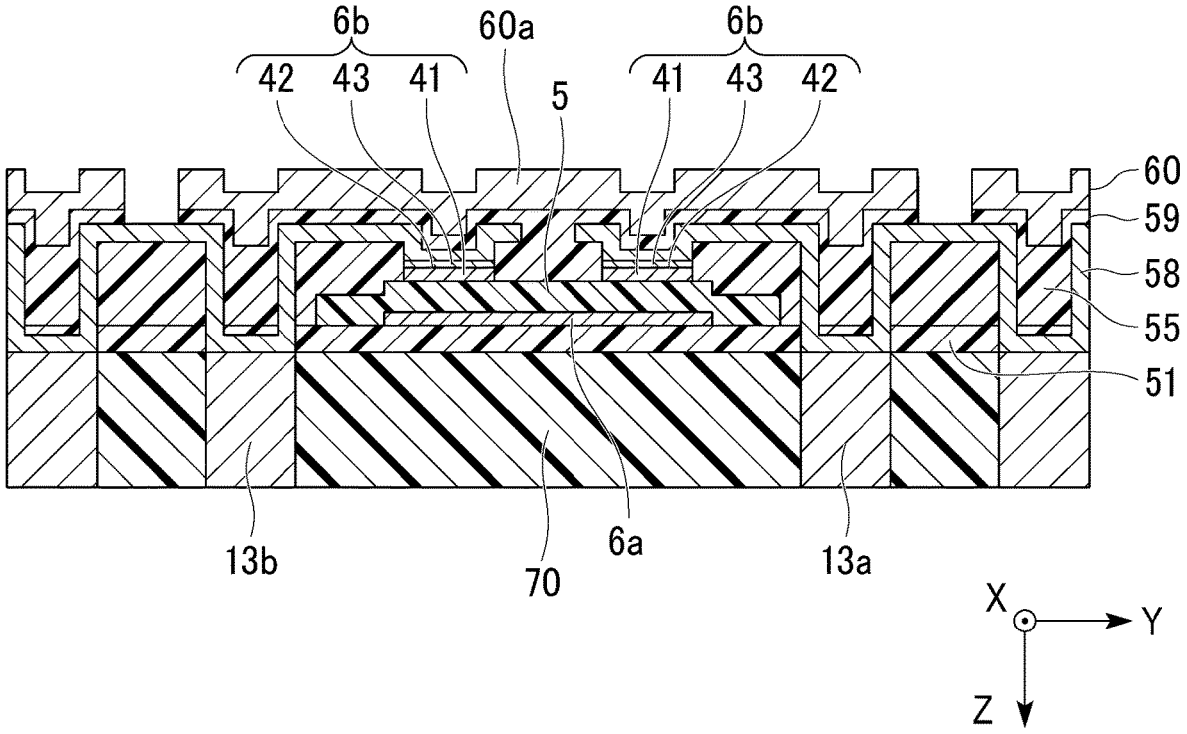
FIG. 32 is a cross-sectional view for sequentially explaining the manufacturing process of the thermistor element shown in FIG. 24.

Next, the NiCr film 60 is formed over the entire surface. A mask layer 60*a* having a shape corresponding to the pair of arm parts 12*a* and 12*b* of the electromagnetic wave sensor 1 is formed by patterning the NiCr film 60 using a photolithography technique as shown in FIG. 32.

Figure 33:
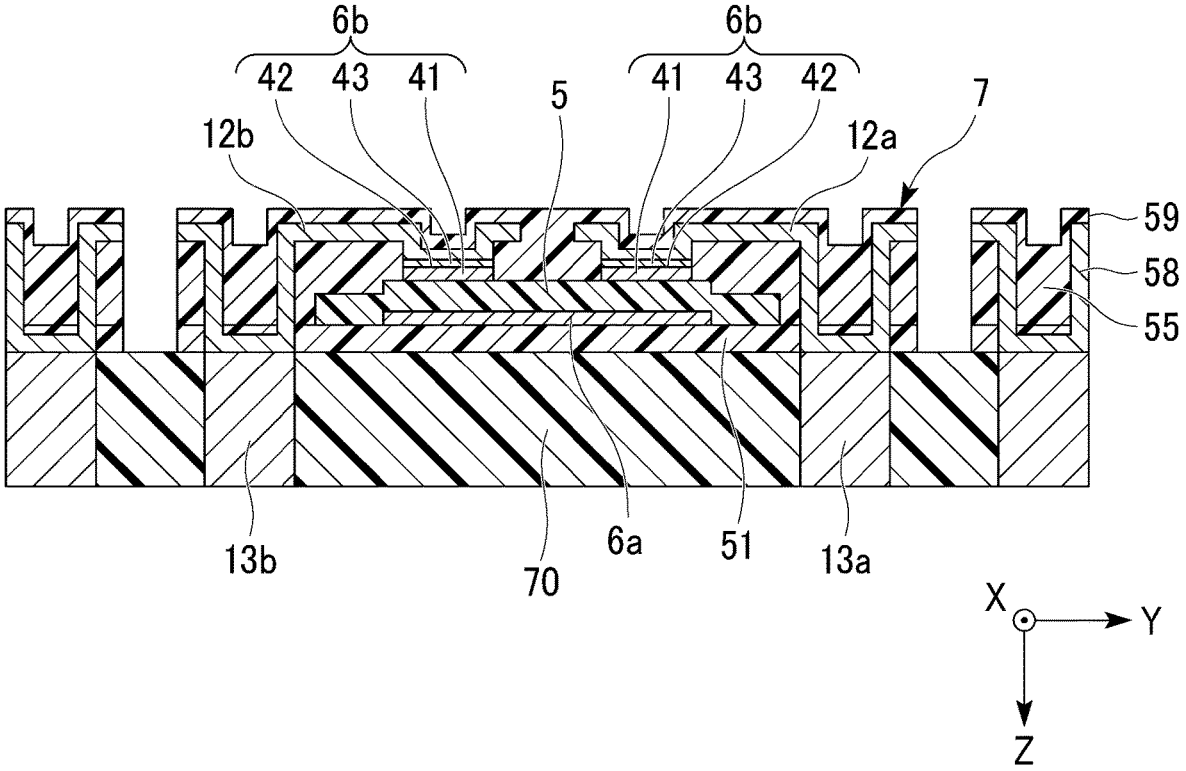
FIG. 33 is a cross-sectional view for sequentially explaining the manufacturing process of the thermistor element shown in FIG. 24.

Next, as shown in FIG. 33, reactive ion etching (RIE) using a chlorine-based gas is performed. At this time, the Ti film 58 and the $SiO_2$ films 59, 55, 51 are removed while patterning until the organic material layer 70 is exposed. Then, the mask layer 60*a* is removed from the surface of the $SiO_2$ film 59. As a result, a pair of arm parts 12*a* and 12*b* are formed.

By going through the above-described processes, the thermistor element 4B can be manufactured.

In the manufacturing process of the thermistor element 4B, the above-described conductive material (NiCr film 61 in this embodiment), which is highly effective conductive material that acts as an etching stopper for reactive ion etching (RIE) using chlorine-based gas, is used for the above-described third conductive layer 43. As a result, the pair of arm parts 12*a* and 12*b* can be easily patterned.

In the electromagnetic wave sensor 1, the thermistor element 4B of the present embodiment can be used instead of the thermistor element 4. In the electromagnetic wave sensor 1, the reliability can be improved by using the thermistor element 4B of the present embodiment.

Further, the present disclosure is not necessarily limited to those in the above-described embodiment, and various modifications can be made in a range not departing from the meaning of the present disclosure.

For example, the electromagnetic wave sensor to which the present disclosure is applied is not necessarily limited to the configuration of the infrared image sensor in which the above-described plurality of thermistor elements 4 are arranged in an array, and the present disclosure can also be applied to an electromagnetic wave sensor using a single thermistor element 4, an electromagnetic wave sensor in which a plurality of thermistor elements 4 are disposed to be linearly aligned, or the like. It is also possible to use the thermistor element 4 as a temperature sensor for measuring a temperature.

Also, the electromagnetic wave sensor to which the present disclosure is applied is not necessarily limited to one for detecting the above-described infrared rays as electromagnetic waves and may also be one for detecting a terahertz wave having a wavelength of, for example, 30 μm or more and 3 mm or less.

While embodiments of the disclosure have been described and illustrated above, it should be understood that these are exemplary of the disclosure and are not to be considered as limiting. Additions, omissions, substitutions, and other modifications can be made without departing from the spirit or scope of the present disclosure. Accordingly, the invention is not to be considered as being limited by the foregoing description and is only limited by the scope of the appended claims.

What is claimed is:

1. A thermistor element comprising:

a thermistor film;

a first electrode provided in contact with at least one surface of the thermistor film; and a pair of second electrodes provided in contact with another surface of the thermistor film, wherein the thermistor film is provided to cover a main surface and a side surface of the first electrode and to be in contact with the main surface and the side surface.

2. The thermistor element according to claim 1, wherein each of regions where the pair of the second electrodes contacts the thermistor film locates in a region where the first electrode contacts the thermistor film in a plan view.

3. The thermistor element according to claim 1, wherein each of the second electrodes has a structure in which a first conductive layer and a second conductive layer are laminated on the other surface of the thermistor film in this order, the first conductive layer is made of an alloy containing one or more selected from: platinum, gold, palladium, ruthenium, silver, rhodium, iridium, and osmium, the second conductive layer is made of at least one selected from: aluminum, tungsten, titanium, tantalum, titanium nitride, tantalum nitride, chromium nitride, and zirconium nitride.

4. The thermistor element according to claim 2, wherein each of the second electrodes has a structure in which a first conductive layer and a second conductive layer are laminated on the other surface of the thermistor film in this order, the first conductive layer is made of an alloy containing one or more selected from: platinum, gold, palladium, ruthenium, silver, rhodium, iridium, and osmium, the second conductive layer is made of at least one selected from: aluminum, tungsten, titanium, tantalum, titanium nitride, tantalum nitride, chromium nitride, and zirconium nitride.

5. The thermistor element according to claim 3, wherein the second electrode comprises a third conductive layer between the first conductive layer and the second conductive layer, and the third conductive layer is made of at least one selected from a NiCr alloy, a NiFe alloy, and ruthenium.

6. The thermistor element according to claim 4, wherein the second electrode comprises a third conductive layer between the first conductive layer and the second conductive layer, and the third conductive layer is made of at least one selected from a NiCr alloy, a NiFe alloy, and ruthenium.

7. An electromagnetic wave sensor comprising at least one thermistor element according to claim 1.

8. The electromagnetic wave sensor according to claim 7, wherein the at least one thermistor element comprises a plurality of thermistor elements, and wherein the thermistor elements are disposed in an array.

* * * * *